US007009560B1

(12) United States Patent
Lam et al.

(10) Patent No.: US 7,009,560 B1
(45) Date of Patent: Mar. 7, 2006

(54) ADAPTIVE VARIABLE TRUE TIME DELAY BEAM-FORMING SYSTEM AND METHOD

(75) Inventors: Lawrence K. Lam, San Jose, CA (US); Bobby L. Ramsey, Elk Grove, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/714,498

(22) Filed: Nov. 14, 2003

Related U.S. Application Data

(60) Provisional application No. 60/426,453, filed on Nov. 15, 2002.

(51) Int. Cl.
*H01Q 3/26* (2006.01)

(52) U.S. Cl. ..... 342/375; 342/374

(58) Field of Classification Search ..... 342/374–375, 342/174

See application file for complete search history.

(56) References Cited

U.S. PATENT DOCUMENTS 3,949,309 A * 4/1976 Pecar ..... 342/17
4,485,363 A * 11/1984 Hunsinger et al. ..... 333/193
4,509,049 A * 4/1985 Haendel et al. ..... 342/87
4,559,538 A * 12/1985 Hetyei et al. ..... 342/412
4,617,569 A * 10/1986 Letoquart ..... 342/412
4,675,682 A * 6/1987 Adam et al. ..... 342/375
4,890,110 A * 12/1989 Kuwahara ..... 342/374
4,912,478 A * 3/1990 Daniel ..... 342/375
5,008,844 A * 4/1991 Kyriakos et al. ..... 342/174
5,640,385 A * 6/1997 Long et al. ..... 370/335
6,191,735 B1 * 2/2001 Schineller ..... 342/375
6,809,685 B1 * 10/2004 Hancock ..... 342/174

OTHER PUBLICATIONS

M. Clenet, Visualisation of the array factor of phased arrays using time delay units and digital phase shifters, IEEE, Antennas and Propagation Society International Symposium, vo1. 1, 520-523, Jun. 2002.*

L.K Lam et al., S-band electronically scanned active phased array antenna, IEEE Aerospace Conference Proceedings, vol. 5, p. 67-72, Mar. 2000.*

Bernard Widrow, "Adaptive Signal Processing", Part 1, Chapters 1 and 2, Prentice-Hall Inc., New Jersey, 1985.

* cited by examiner

*Primary Examiner*—Thomas H. Tarcza
*Assistant Examiner*—F H Mull
(74) *Attorney, Agent, or Firm*—McDermott Will & Emery LLP

(57) ABSTRACT

System and method for signal processing and beam forming. A system for processing signals includes a first phase shifter, a second phase shifter, a first variable time delay system, and a second variable time delay system. Additionally, the system includes a first signal processing system and a sampling system. Moreover, the system includes a switching system and a measuring system.

14 Claims, 23 Drawing Sheets

ADAPTIVE VARIABLE TRUE TIME DELAY BEAM-FORMING SYSTEM AND METHOD

CROSS-REFERENCES TO RELATED APPLICATIONS

The application claims priority to U.S. Provisional Application No. 60/426,453 filed Nov. 15, 2002, which is incorporated by reference herein.

BACKGROUND OF THE INVENTION

The present invention relates in general to detecting objects and/or areas. More particularly, the invention provides a method and system for adaptive variable true time delay beam forming. Merely by way of example, the invention is described as it applies to a phased array antenna, but it should be recognized that the invention has a broader range of applicability.

A phased array antenna has been widely used for communications and radar systems. The phased array antenna usually does not mechanically steer antenna directions, and can provide rapid beam scanning. The directivity of the phased array antenna can be achieved by properly adjusting the relative phases between signals transmitted or received by different antenna elements. These antenna elements can reinforce the transmitted or received radiation in a desired direction.

FIG. 1 is a simplified diagram for a conventional phased array antenna. An arrival signal 140 with a center wavelength $\lambda_0$ arrives at an array of antenna elements 110. The angle of arrival is $\theta_0$. Phase shifters 120 are applied to the outputs of the antenna elements 110 and generate phase delayed signals. The sum of the phase delayed signals forms an output beam 130. The phase shifters 120 are usually adequate for forming the output beam 130 if the 3 dB bandwidth of the arriving signal 140 is narrow and the scan angle $\theta_0$ is small. Otherwise, a time delay circuit is usually needed for beam formation. For example, the time delay is needed when $$B > \frac{0.886}{\tau_0} \quad \text{(Equation 1)}$$

$$\tau_0 = \frac{N d_x \sin\theta_0}{f_0 \lambda_0} \quad \text{(Equation 2)}$$

where B is the 3 dB bandwidth of the arriving signal 140, and $\tau_0$ is the total time delay across the array of antennal elements 110. Additionally, $f_0$ is the center frequency of the arriving signal 140, N is the total number of antenna elements 110, $d_x$, is the distance between two adjacent antenna elements 110, and $\theta_0$ is the angel of arrival. As another example, if the total time delay, $\tau_0$, across the array of antenna elements 110 is greater than the reciprocal of the 3 dB bandwidth, the time delay is usually needed for beam forming.

In certain beam forming applications, the received or transmitted signals need to maintain phase continuity and avoid any abrupt phase transition. Phase continuous variable true time delay circuits are usually used. The phase continuous variable true time delay circuits can be implemented by switching in and out of a plurality of RF cables or optical fibers of different lengths. But during the switching of cables, an abrupt phase transition may be introduced into the processed signals. As the size of the antenna aperture and the number of antenna elements become large, testing and calibration of the entire antenna system also become difficult.

Hence it is highly desirable to improve techniques for adaptive variable true time delay beam forming.

BRIEF SUMMARY OF THE INVENTION

The present invention relates in general to detecting objects and/or areas. More particularly, the invention provides a method and system for adaptive variable true time delay beam forming. Merely by way of example, the invention is described as it applies to a phased array antenna, but it should be recognized that the invention has a broader range of applicability.

According to a specific embodiment of the present invention, a system for processing signals includes a first phase shifter configured to receive or generate a first signal, a second phase shifter configured to receive or generate a second signal, a first variable time delay system coupled to the first phase shifter and configured to generate or receive a third signal, and a second variable time delay system coupled to the second phase shifter and configured to generate or receive a fourth signal. Additionally, the system includes a first signal processing system coupled to the first variable time delay system and the second variable time delay system and configured to generate or receive a fifth signal, and a sampling system configured to sample at least the third signal and the fourth signal and generate at least a sixth signal and a seventh signal respectively. Moreover, the system includes a switching system configured to receive the at least a sixth signal and a seventh signal and output an eighth signal and a ninth signal. The eighth signal is the same as one of the at least a sixth signal and a seventh signal, and the ninth signal is the same as one of the at least a sixth signal and a seventh signal. Also, the system includes a measuring system configured to receive the eighth signal and the ninth signal and process at least information associated with the eighth signal and the ninth signal.

According to another embodiment of the present invention, a system for providing a time delay to a signal includes a first signal processing system configured to receive or generate a first combined signal and to generate or receive at least a first divided signal and a second divided signal, a first time delay system configured to receive or generate the first divided signal, generate or receive a third divided signal, and provide a first time delay to the first divided signal or the third divided signal, and a second time delay system configured to received or generate the second divided signal, generate or received a fourth signal, and provide a second time delay to the second divided signal or the fourth divided signal. Additionally, the system includes a first phase shifter configured to receive or generate the third divided signal, generate or receive a fifth divided signal, and provide a first phase shift to the third divided signal or the fifth divided signal, and a second phase shifter configured to receive or generate the fourth divided signal, generate or receive a sixth divided signal, and provide a second phase shift to the fourth divided signal or the sixth divided signal. Moreover, the system includes a first attenuator configured to receive or generate the fifth divided signal and generate or receive a seventh divided signal, and a second attenuator configured to receive or generate the sixth divided signal and generate or receive an eighth divided signal. Also, the system includes a second signal processing system configured to receive or generate the seventh divided signal and the eighth divided signal and generate or receive a second combined signal.

According to yet another embodiment of the present invention, a method for processing signals includes selecting a reference signal, selecting a first signal, and processing information associated with the reference signal and the first signal. Additionally, the method includes determining a first phase shift based on at least information associated with the reference signal and the first signal, applying the first phase shift to the first signal, determining a first time delay based on at least information associated with the reference signal and the first signal, and applying the first time delay to the first signal. The applying the first phase shift to the first signal is associated with the first phase-shifted signal. The first phase-shifted signal is substantially free from any phase difference with respect to the reference signal at a predetermined frequency. The applying the first time delay to the first signal is associated with the first phase-shifted and time-delayed signal. The first phase-shifted and time-delayed signal is substantially free from any phase difference with respect to the reference signal within a frequency range. The frequency range includes the predetermined frequency.

According yet another embodiment of the present invention, a method for processing signals includes selecting a first signal from a plurality of signals. A sum of the plurality of signals is a combined signal. The combined signal is associated with a first phase difference with respect to the first signal at a predetermined frequency. Additionally, the method includes processing information associated with the combined signal and the first signal, determining a first phase shift and a first time delay based on at least information associated with the combined signal and the first signal, and applying the first phase shift and the first time delay to the first signal to generate the first phase-shifted and time-delayed signal. The first phase-shifted and time-delayed signal is associated with a second phase difference at the predetermined frequency with respect to a first combined phase-shifted and time-delayed signal. The first combined phase-shifted and time-delayed signal is equal to a sum of the first phase-shifted and time-delayed signal and the plurality of signals other than the first signal. The second phase difference is smaller than the first phase difference at the predetermined frequency.

According to yet another embodiment of the present invention, a method for processing signals includes receiving a first combined signal, and generating a first divided signal and a second divided signal based on at least information associated with the first combined signal. Additionally, the method includes applying a first time delay to the first divided signal, applying a second time delay to the second divided signal, applying a first phase shift to the first divided time-delayed signal, and applying a second phase shift to the second divided time-delayed signal. Moreover, the method includes applying a first attenuation to the first divided time-delayed and phase-shifted signal, applying a second attenuation to the second divided time-delayed and phase-shifted signal, generating a second combined signal based on at least information associated with the first attenuated divided time-delayed and phase-shifted signal and the second attenuated divided time-delayed and phase-shifted signal.

According to yet another embodiment of the present invention, a method for using a system includes providing a system. The system includes a first signal processing system, a first time delay system coupled to the first signal processing system and configured to provide a first time delay, a second time delay system coupled to the first signal processing system and configured to provide a second time delay, and a third time delay system coupled to the first signal processing system and configured to provide a third time delay. Additionally, the system includes a first phase shifter coupled to the first time delay system and configured to provide a first phase shift within a first phase shift range, a second phase shifter coupled to the second time delay system and configured to provide a second phase shift within a second phase shift range, and a third phase shifter coupled to the third time delay system and configured to provide a third phase shift within a third phase shift range. Moreover, the system includes a first attenuator coupled to the first phase shifter and configured to provide a first attenuation within a first attenuation range, a second attenuator coupled to the second phase shifter and configured to provide a second attenuation within a second attenuation range, and a third attenuator coupled to the third phase shifter and configured to provide a third attenuation within a third attenuation range. Also, the system includes a second signal processing system coupled to the first attenuator, the second attenuator and the third attenuator. The first time delay is shorter than or equal to the second time delay and the second time delay is shorter than or equal to the third time delay. Additionally, the method includes inputting a first signal to the first signal processing system, measuring a second signal from the second signal processing system, processing information associated with the first signal and the second signal, and determining a reference time delay between the second signal and the first signal based on at least information associated with the first signal and the second signal. Moreover, the method includes establishing a first phase synchronization between a first output of the first attenuator and a second output of the second attenuator at a predetermined frequency, establishing a second phase synchronization between a third output of the third attenuator and the second output of the second attenuator at the predetermined frequency, and adjusting at least one of the first attenuation, the second attenuation, and the third attenuation. Also, the method includes measuring a third signal from the second signal processing system, processing information associated with the first signal and the third signal, and determining a relative time delay between the third signal and the first signal with respect to the reference time delay based on at least information associated with the first signal and the third signal.

According to yet another embodiment of the present invention, a method for using a system includes providing a system. The system includes a first phase shifter configured to provide a first phase shift, a second phase shifter configured to provide a second phase shift, a first variable time delay system coupled to the first phase shifter and configured to provide a first time delay, and a second variable time delay system coupled to the second phase shifter and configured to provide a second time delay. Additionally, the system includes a signal processing system coupled to the first variable time delay system and the second variable time delay system, a sampling system configured to sample at least a first output of the first variable time delay system and a second output of the second variable time delay system, a switching system configured to receive the at least a first output and a second output and output a third signal and a fourth signal. The third signal is the same as one of the at least a first output and a second output, and the fourth signal is the same as one of the at least a first output and a second output. Moreover, the system includes a measuring system configured to process at least information associated with the third signal and the fourth signal. Additionally, the method includes inputting a fifth signal to the first phase shifter, and inputting a sixth signal to the second phase shifter. The sixth signal and the fifth signal are associated with substantially the same phase and the same time delay. Moreover, the method includes adjusting the first output and the second output. The adjusted first output and the adjusted second output are associated with substantially the same phase and the same time delay. Also, the method includes processing information associated with the third signal and the fourth signal. The third signal is related to the fifth signal, and the fourth signal is related to the sixth signal. Additionally, the method includes determining a phase difference based on at least information associated with the third signal and the fourth signal.

According to yet another embodiment of the present invention, a system for processing signals includes a first signal processing system, a first time delay system coupled to the first signal processing system and configured to provide a first time delay, and a second time delay system coupled to the first signal processing system and configured to provide a second time delay. Additionally, the system includes a first phase shifter coupled to the first time delay system and configured to provide a first phase shift, a second phase shifter coupled to the second time delay system and configured to provide a second phase shift, a first attenuator coupled to the first phase shifter and configured to provide a first attenuation, and a second attenuator coupled to the second phase shifter and configured to provide a second attenuation. Moreover, the system includes a second signal processing system coupled to the first attenuator and the second attenuator.

According to yet another embodiment of the present invention, a system for processing signals includes a first phase shifter configured to provide a first phase shift, a second phase shifter configured to provide a second phase shift, a first variable time delay system coupled to the first phase shifter and configured to provide a first time delay, and a second variable time delay system coupled to the second phase shifter and configured to provide a second time delay. Additionally, the system includes a signal processing system coupled to the first variable time delay system and the second variable time delay system, a sampling system configured to sample at least a first output of the first variable time delay system and a second output of the second variable time delay system, a switching system configured to receive the at least a first output and a second output and output a third signal and a fourth signal. The third signal is the same as one of the at least a first output and a second output, and the fourth signal is the same as one of the at least a first output and a second output. Also, the system includes a measuring system configured to process at least information associated with the third signal and the fourth signal.

Many benefits may be achieved by way of the present invention over conventional techniques. For example, certain embodiments of the present invention reduce complexity of calibration process that usually involves physical manipulation of a large phased array antenna. Some embodiments of the present invention reduce the amount of time required for system integration in the factory. After system deployment, periodic maintenance procedures for periodic test, calibration and performance verifications can be simplified. Certain embodiments of the present invention can make real time measurements and estimate relative time delays and phase delays between received signals. Some embodiments of the present invention can lower the costs of making and using phased array antenna systems.

Depending upon the embodiment under consideration, one or more of these benefits may be achieved. These benefits and various additional objects, features and advantages of the present invention can be fully appreciated with reference to the detailed description and accompanying drawings that follow.

DETAILED DESCRIPTION OF THE INVENTION

The present invention relates in general to detecting objects and/or areas. More particularly, the invention provides a method and system for adaptive variable true time delay beam forming. Merely by way of example, the invention is described as it applies to a phased array antenna, but it should be recognized that the invention has a broader range of applicability.

Figure 1:
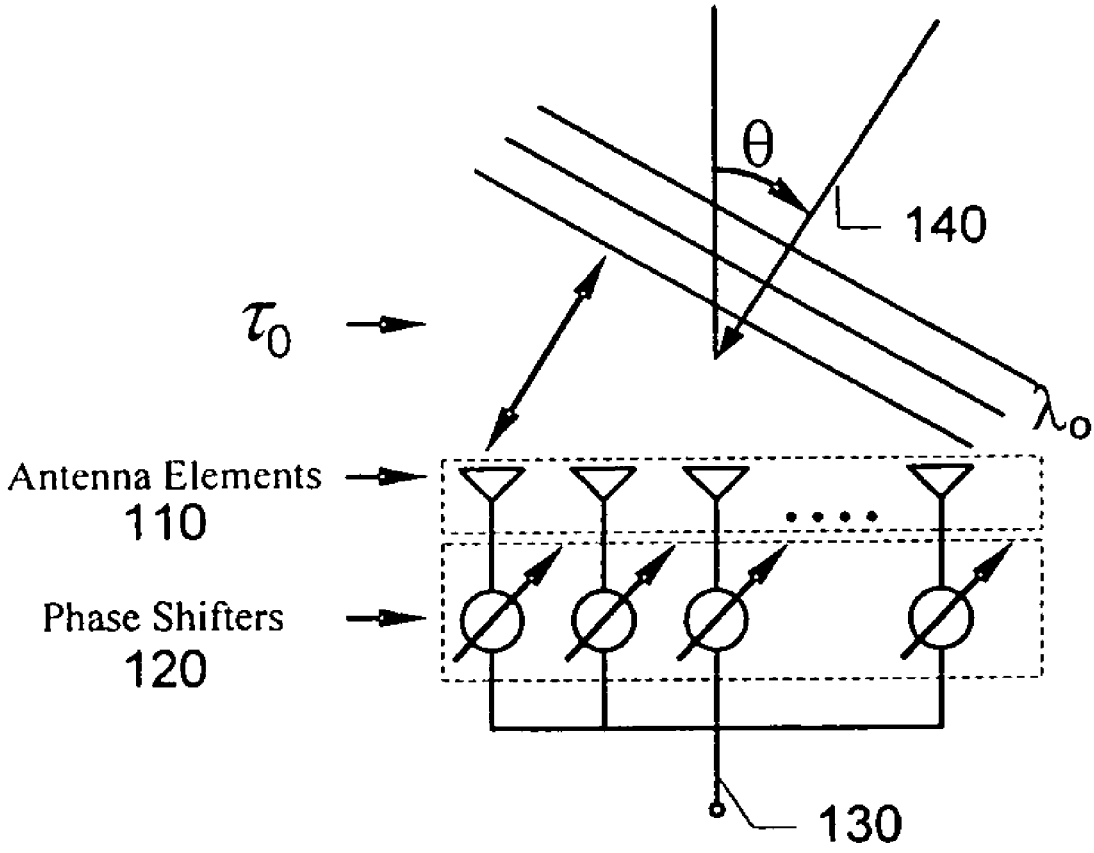
Fig. 1 (Prior Art)
FIG. 1 is a simplified diagram for a conventional phased array antenna.

As shown in FIG. 1, the bandwidth of a phased array antenna can be limited by the bandwidth of the antenna elements 110 and the use of the phase shifters 120 for beam forming. For example, the antenna elements 110 form a linear array with N elements and element spacing $d_x$. The beam former uses the following set of complex weights $$\left\{1, \exp\left(j\frac{2\pi}{\lambda_o}1d_x\sin\theta_o\right), \exp\left(j\frac{2\pi}{\lambda_o}2d_x\sin\theta_o\right), \ldots \exp\left(j\frac{2\pi}{\lambda_o}(N-1)d_x\sin\theta_o\right)\right\}$$

to form a beam in the direction of $\theta_o$, and provides the optimal signal to noise gain for a signal at the center frequency $f_o$. $\lambda_o$ denotes the wavelength corresponding to $f_o$. The output of the beam former for a signal at $f_o+\Delta f$ and from the same direction $\theta_0$ may be expressed by $$\frac{\sin\left\{\frac{\pi N d_x \sin\theta_o}{\lambda_o}\left(\frac{\Delta f}{f_o}\right)\right\}}{\sin\left\{\frac{\pi d_x \sin\theta_o}{\lambda_o}\left(\frac{\Delta f}{f_o}\right)\right\}} \quad \text{(Equation 3)}$$

where N is the total number of antenna elements, $d_x$ is the distance between two adjacent antenna elements, $\theta_0$ is the angel of arrival or scan angle, and $\Delta f$ is the frequency away from $f_o$. As the factor $N\times d_x\times\Delta f\times\sin\theta_0$ increases, the attenuation of a signal at $(f_o+\Delta f)$ and $\theta_o$ increases rapidly.

FIGS. 2–5 are simplified diagrams for response of a phased array antenna as a function of number of antenna elements, scan angle and signal frequency. The phased array antenna has a linear array of antenna elements. These diagrams are merely examples, which should not unduly limit the scope of the present invention. One of ordinary skill in the art would recognize many variations, alternatives, and modifications.

Figure 2:
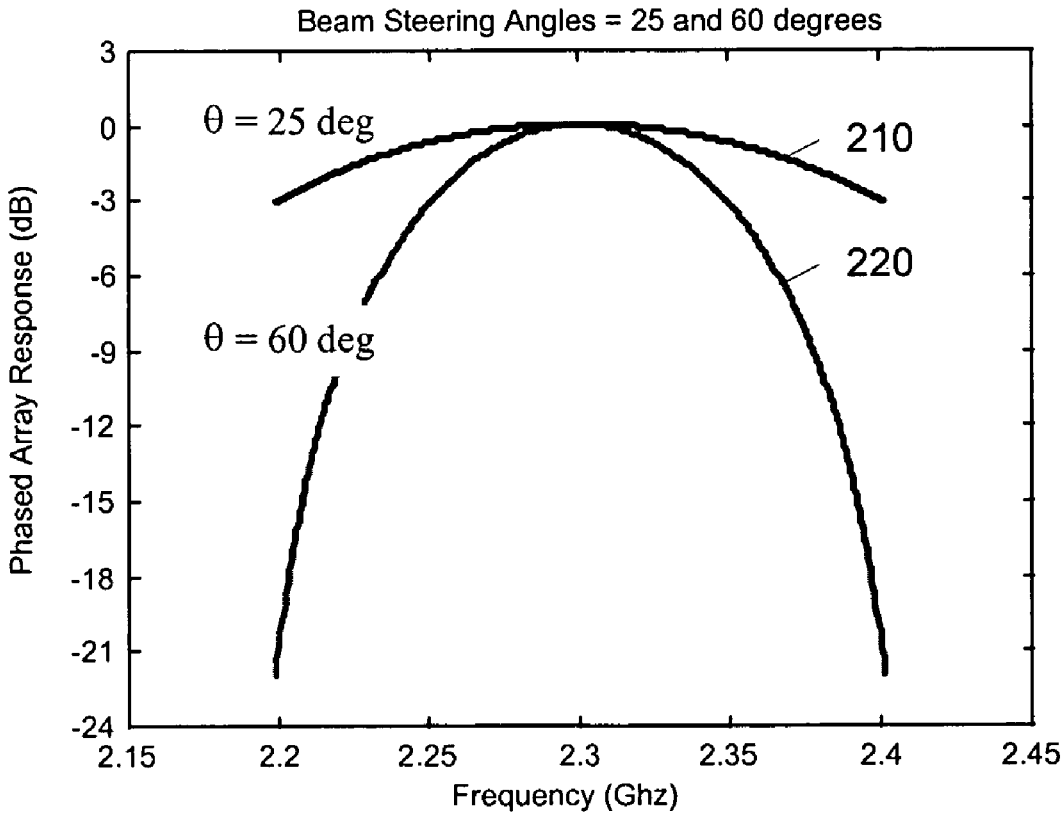
FIGS. 2–5 are simplified diagrams for response of a phased array antenna as a function of number of antenna elements, scan angle and signal frequency.
Figure 3:
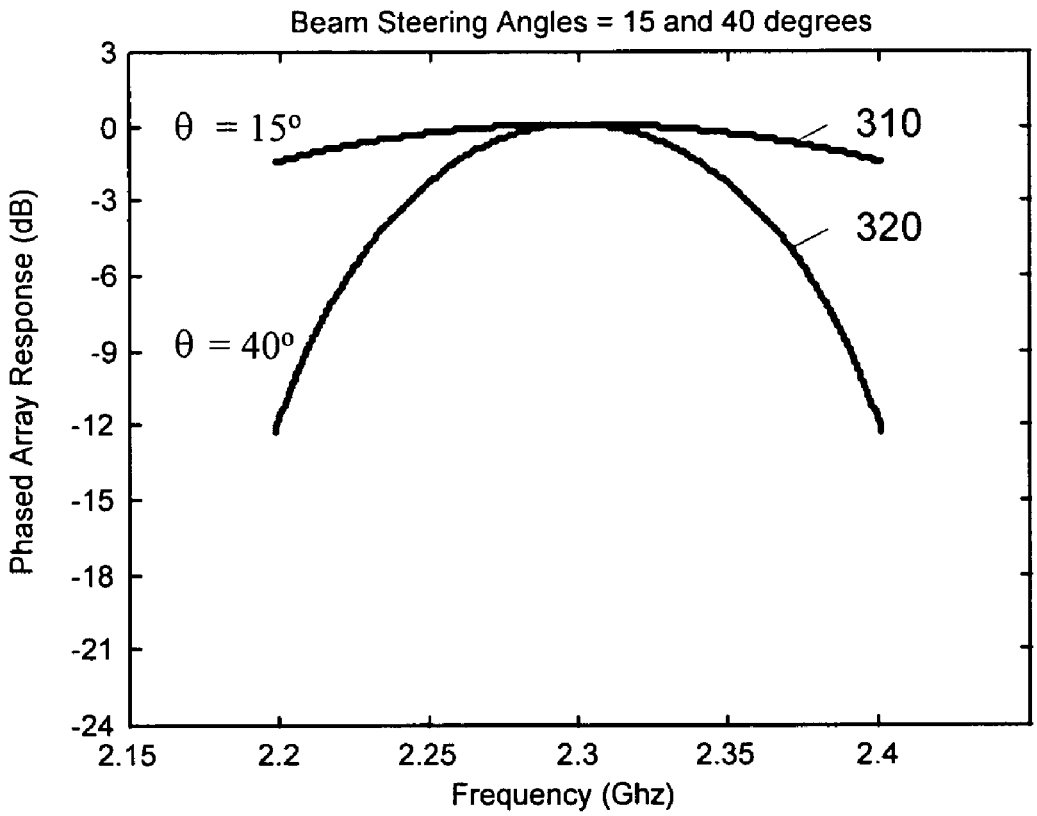

FIG. 2 is a simplified diagram for response of a phased array antenna as a function of frequency with N equal to 48 elements and $d_x$ equal to 2.6 inches. The frequency responses for scan angles of 25° and 60° are shown as curves 210 and 220 respectively. FIG. 3 is a simplified diagram for response of a phased array antenna as a function of frequency with N equal to 48 elements and $d_x$ equal to 3.0 inches. The frequency responses for scan angles of 15° and 40° are shown as curves 310 and 320 respectively.

Figure 4:
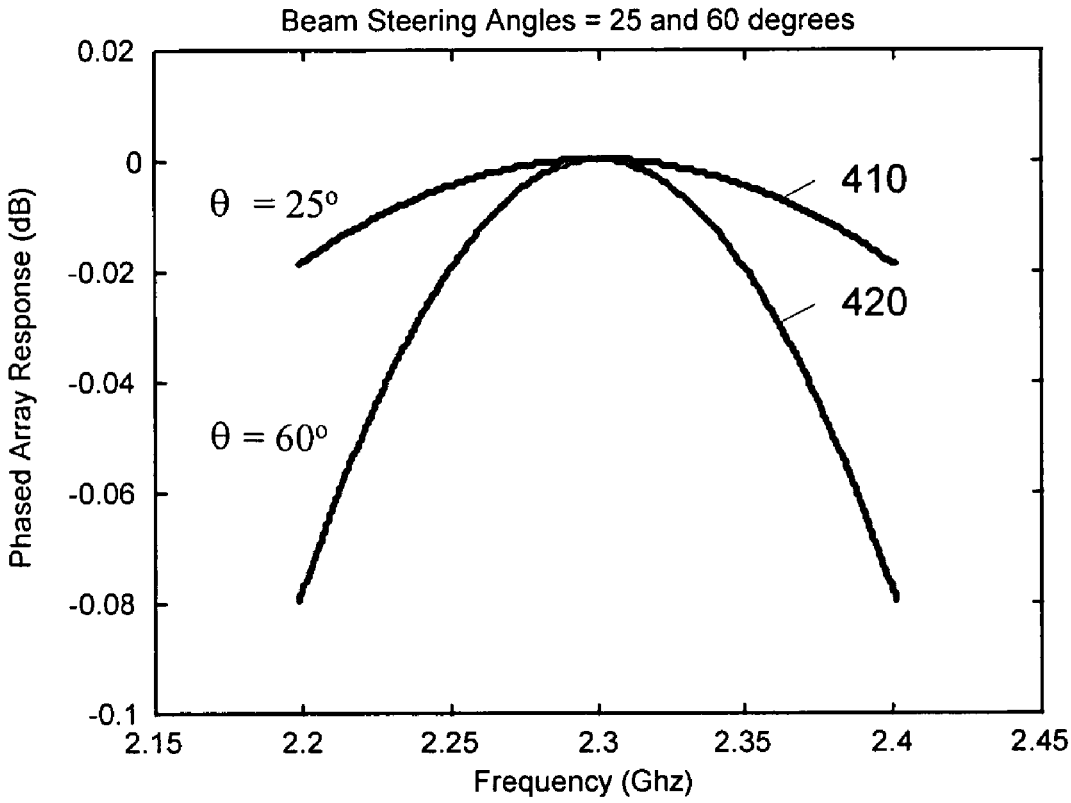
Figure 5:
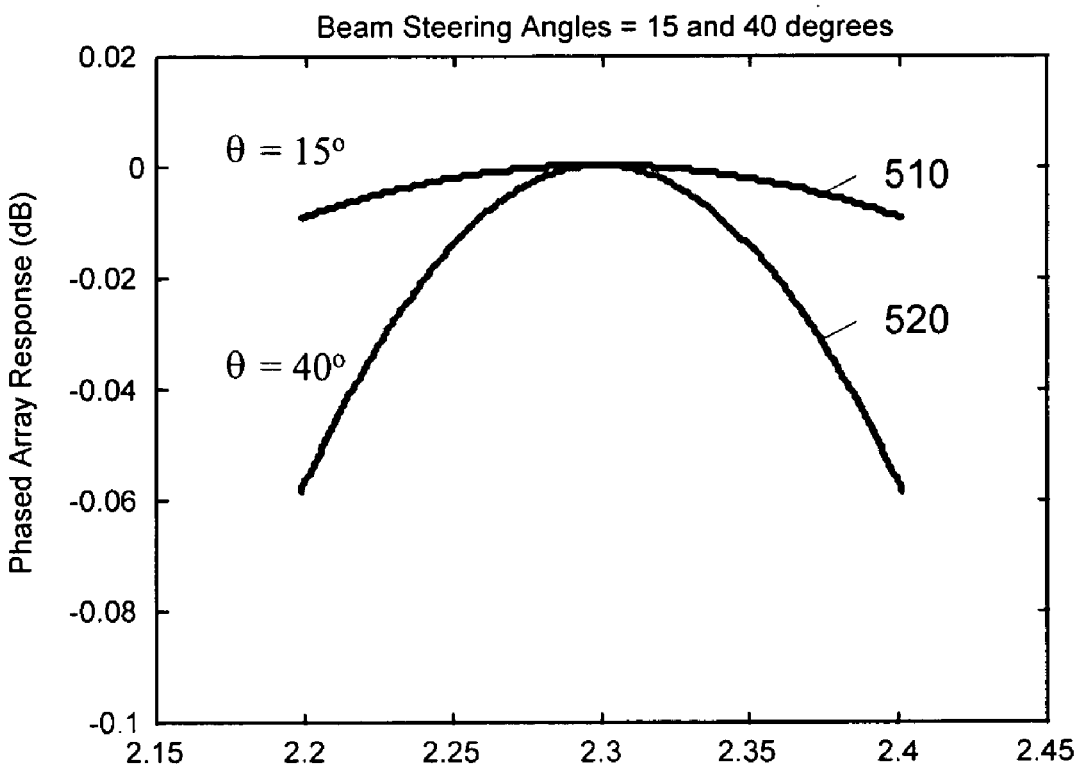

FIG. 4 is a simplified diagram for response of a phased array antenna as a function of frequency with N equal to 4 elements and $d_x$ equal to 2.6 inches. The frequency responses for scan angles of 25° and 60° are shown as curves 410 and 420 respectively. FIG. 5 is a simplified diagram for response of a phased array antenna as a function of frequency with N equal to 4 elements and $d_x$ equal to 3.0 inches. The frequency responses for scan angles of 15° and 40° are shown as curves 510 and 520 respectively. The comparisons between FIGS. 2 and 4 and between FIGS. 3 and 5 show that reduction of array size can significantly improve the frequency response near the band edges. For example, at 2.2 GHz and 25°, the frequency response improves from about −3 dB as shown by the curve 210 to about −0.02 dB as shown by the curve 410. As another example, for the curve 510, the drop off in the frequency response is probably hardly measurable.

As shown in FIGS. 2–5, as the factor $(N\times d_x\Delta f\times\sin\theta_0)$ increases, the attenuation of a signal at $(f_o+\Delta f)$ and $\theta_o$ increases rapidly. In order to compensate the large attenuation, a time delay circuit can be used in the beam forming process.

Figure 6:
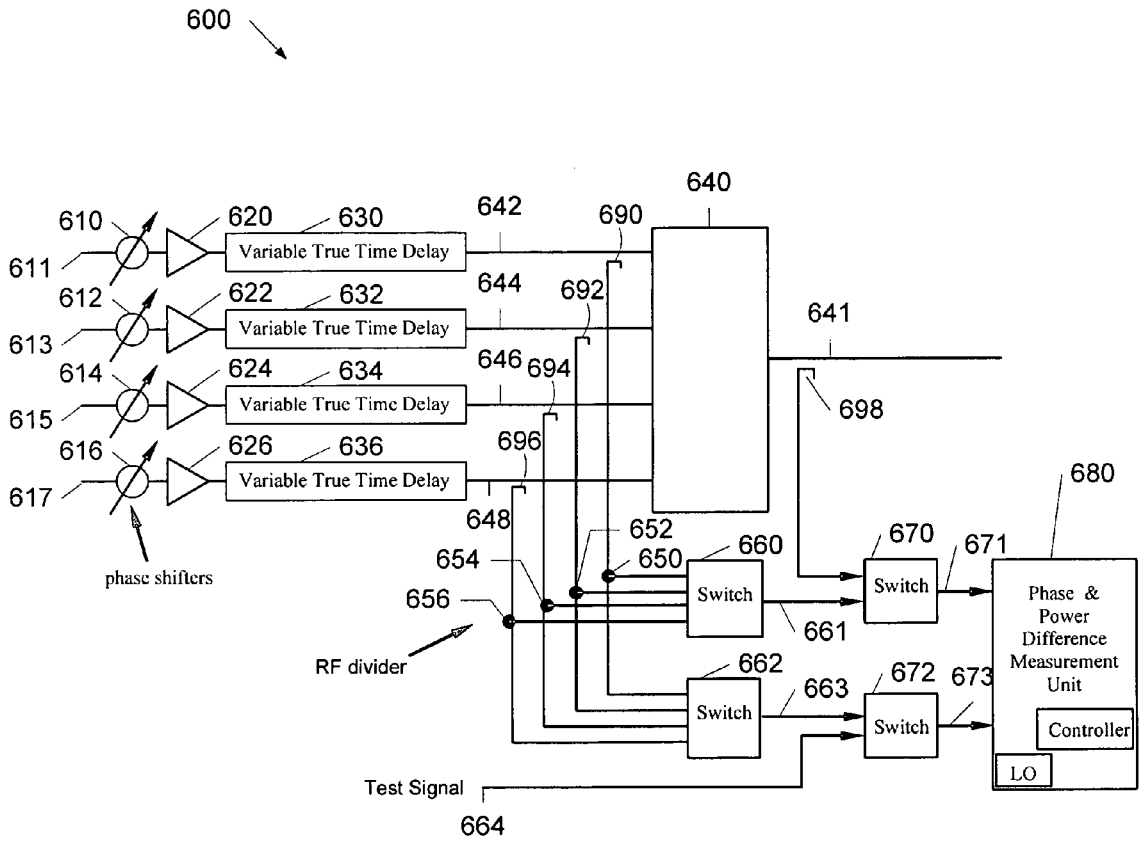
FIG. 6 is a simplified diagram for an adaptive variable true time delay beam forming system according to one embodiment of the present invention.

FIG. 6 is a simplified diagram for an adaptive variable true time delay beam forming system according to one embodiment of the present invention. This diagram is merely an example, which should not unduly limit the scope of the present invention. One of ordinary skill in the art would recognize many variations, alternatives, and modifications. A time delay beam forming system 600 includes phase shifters 610, 612, 614 and 616, amplifiers 620, 622, 624 and 626, a combiner and divider system 640, a divider systems 650, 652, 654 and 656, switches 660, 662, 670 and 672, a correlative receiver 680, and signal couplers 690, 692, 694, 696 and 698. Although the above has been shown using various systems, there can be many alternatives, modifications, and variations. For example, some of the systems may be expanded and/or combined. Additional phase shifters, amplifiers, and variable true time delay systems may be added to generate additional inputs to the combiner and divider system 640, or receive additional outputs from the combiner and divider system 640. Other systems may be inserted to those noted above. One or both of the switches 670 and 672 may be removed. One of the switches 660 and 662 can be removed. Depending upon the embodiment, the specific systems may be replaced. The time delay beam forming system 600 can be used to transmit signals, receive signals, or transmit and receive signals. To transmit signals, the direction of the amplifiers 620, 622, 624 and 626 may be reversed. Further details of these systems are found throughout the present specification and more particularly below.

The phase shifters 610, 612, 614 and 616 receive or generate signals 611, 613, 615 and 617 respectively. These signals are substantially identical except for their relatively time delay and phase delay differences. In the reception mode, these differences are compensated by the phase shifters 610, 612, 614 and 616 and variable true time delays systems 620, 622, 624 and 626. In the transmission mode, these differences are generated by the phase shifters 610, 612, 614 and 616 and variable true time delays systems 620, 622, 624 and 626.

The variable true time delay systems 630, 632, 634 and 636 generate or receive signals 642, 644, 646 and 648 respectively. The combiner and divider system 640 generates or receives a signal 641. These signals 642, 644, 646, 648 and 641 are sampled by signal couplers 690, 692, 694, 696 and 698 respectively, and routed to the correlative receiver 680 for measurement. The routing system includes switches 660, 662, 670 and 672. The switch 660 receives the signals 642, 644, 646 and 648 and selects one of them as its output signal 661. The switch 670 receives the signals 661 and 641 and selects one of them as its output signal 671. Similarly, the switch 662 receives the signals 642, 644, 646 and 648 and selects one of them as its output signal 663. The switch 672 receives the signals 663 and a test signal 664 and selects one of them as its output signal 673. As discussed above, the signals 642, 644, 646, 648 and 641 received by the routing system and its components refer to samples of the signals 642, 644, 646, 648 and 641 that are obtained through the signal couplers 690, 692, 694, 696 and 698 respectively.

The correlative receiver 680 receives the signals 671 and 673 and measure information related to the phase and time delay differences of these signals. See U.S. patent application Ser. No. 10/693,321, in the name of Lawrence K. Lam, et al., titled, "System and Method for Cross Correlation Receiver,". This patent application is incorporated by reference herein for all purposes. These phase and time delay differences can be reduced to substantially zero by iteratively adjusting the phase shifters 610, 612, 614 and 616 and variable true time delay systems 630, 632, 634 and 636.

Figure 7:
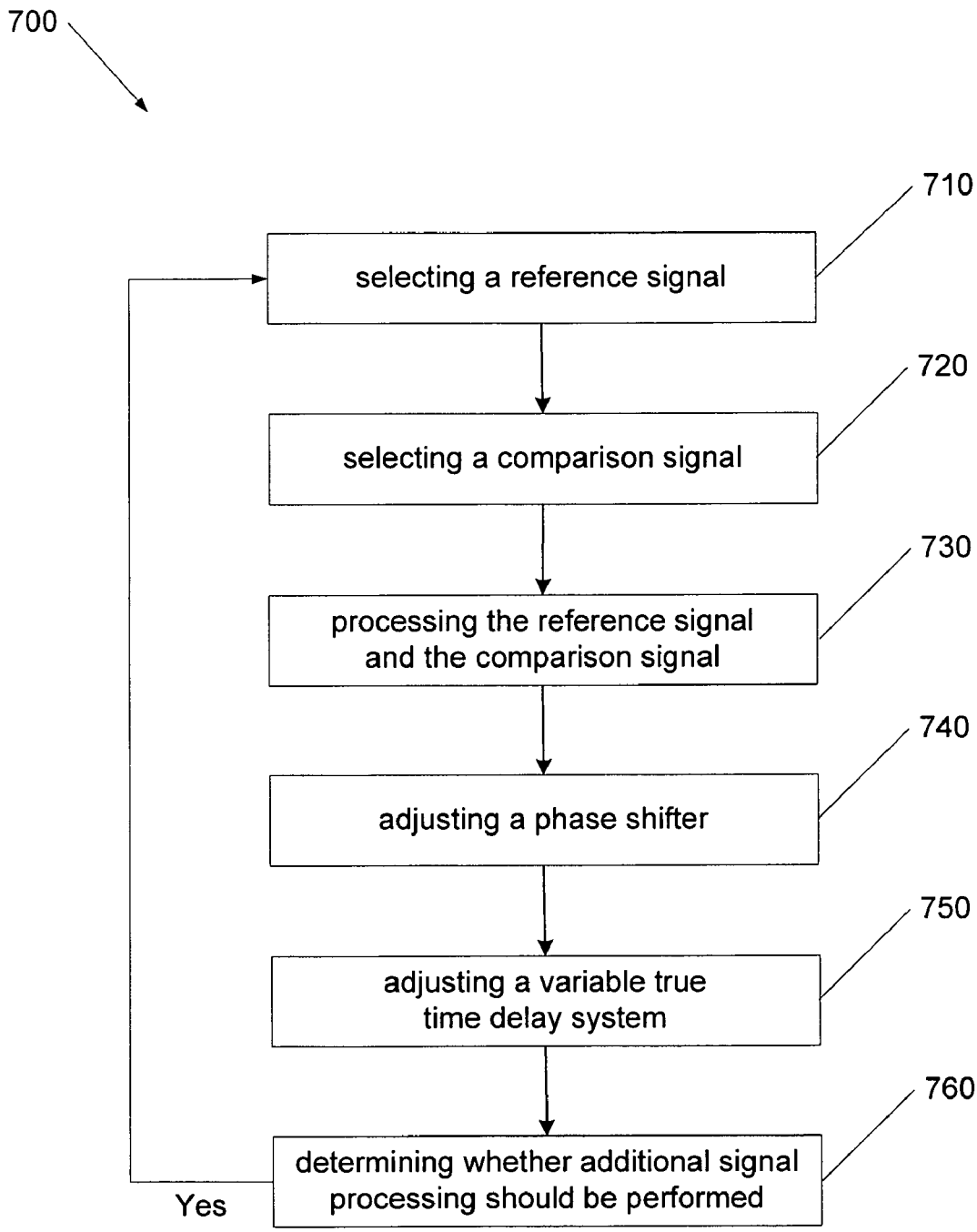
FIG. 7 is a simplified block diagram for an adaptive variable true time delay beam forming method according to one embodiment of the present invention.

FIG. 7 is a simplified block diagram for an adaptive variable true time delay beam forming method according to one embodiment of the present invention. This diagram is merely an example, which should not unduly limit the scope of the claims. One of ordinary skill in the art would recognize many variations, alternatives, and modifications. A time delay beam forming method 700 includes a process 710 for selecting a reference signal, a process 720 for selecting a comparison signal, a process 730 for processing the reference signal and the comparison signal, a process 740 for adjusting a phase shifter, a process 750 for adjusting a variable true time delay system, and a process 760 for determining whether additional signal processing should be performed. Although the above has been shown using a selected sequence of processes, there can be many alternatives, modifications, and variations. For example, some of the processes may be expanded and/or combined. The processes 740 and 750 can be combined. Other processes may be inserted to those noted above. Depending upon the embodiment, the specific sequence of steps may be interchanged with others replaced. Further details of these elements are found throughout the present specification and more particularly below.

At the process 710, a reference signal is selected from the signals 642, 644, 646 and 648. For example, the switch 660 receives the signals 642, 644, 646 and 648 and selects the signal 642 as its output signal 661. The switch 670 receives the signals 641 and 642 and selects the signal 642 as its output signal 671. The signal 642 is the reference signal.

At the process 720, a comparison signal is selected from the signals 642, 644, 646 and 648. For example, the switch 662 receives the signals 642, 644, 646 and 648 and selects the signal 644 as its output signal 663. The switch 672 receives the signals 644 and 664 and selects the signal 644 as its output signal 673. The signal 644 is the comparison signal.

Figure 8:
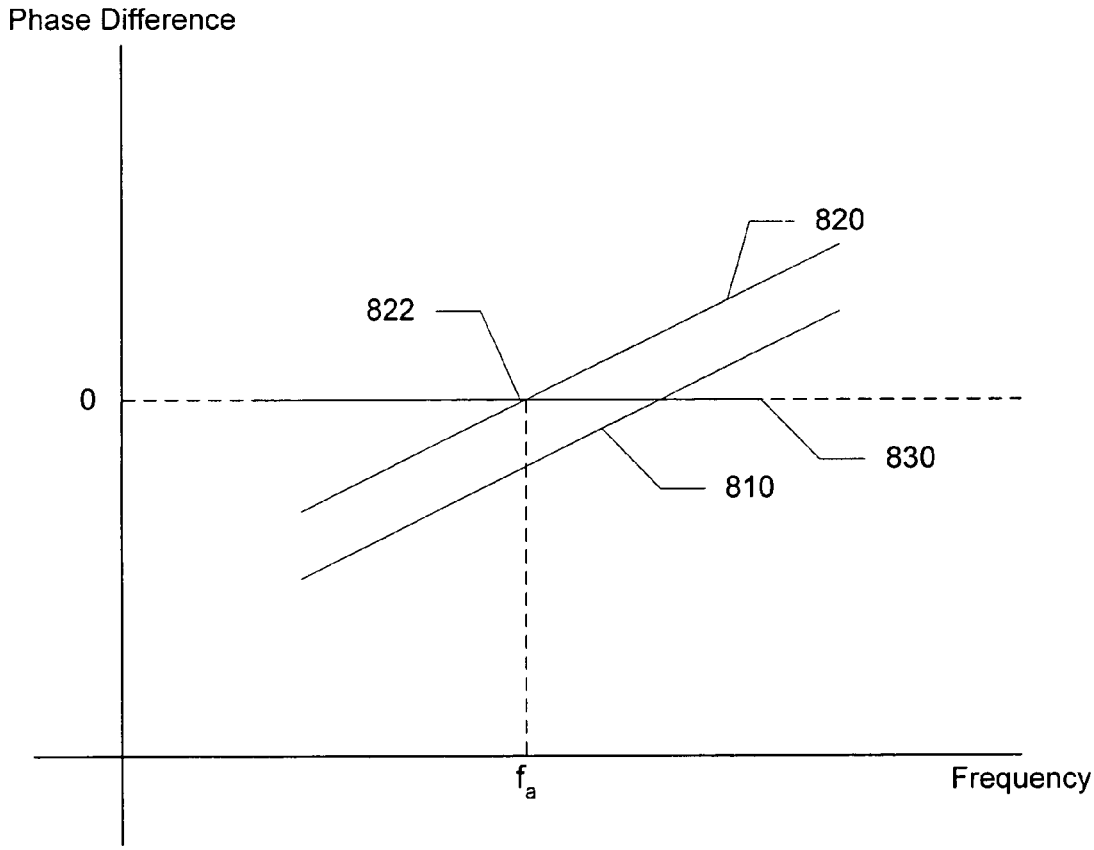
FIG. 8 is a simplified diagram for phase and time delay differences between two signals according to one embodiment of the present invention.

At the process 730, the reference signal and the comparison signal are processed. For example, the correlative receiver 680 receives the signals 642 and 644 from the switches 670 and 672 respectively. The correlative receiver 680 processes the signals 642 and 644 and measures information related to their phase and time delay differences. FIG. 8 is a simplified diagram for phase and time delay differences between two signals according to one embodiment of the present invention. This diagram is merely an example, which should not unduly limit the scope of the claims. One of ordinary skill in the art would recognize many variations, alternatives, and modifications. A curve 810 represents the phase difference between two input signals to the correlative receiver 680 as a function of frequency. The curve 810 is substantially a straight line, and its slope represents the time delay between the two input signals.

At the process 740, a phase shifter is adjusted. The phase shifter corresponds to the comparison signal. For example, the phase shifter 612 corresponds to the signal 644. The phase shifter 612 is adjusted so that the phase difference between the signals 642 and 644 becomes zero at a predetermined frequency. As shown in FIG. 8, the curve 810 is moved up in parallel and becomes a curve 820. The curve 820 represents a zero phase difference at a predetermined frequency fa. For example, the frequency $f_a$ is the center frequency of the signals 642 and 644.

At the process 750, a variable true time delay system is adjusted. For example, the variable true time delay system 632 corresponds to the signal 644. The variable true time delay system 632 is adjusted so that the phase difference between the signals 642 and 644 becomes zero within a frequency range. As shown in FIG. 8, the curve 820 is rotated with a pivot point 822 and becomes a curve 830. The curve 830 represents a zero phase difference at a frequency range from $f_1$ to $f_h$. For example, the frequency range from $f_1$ to $f_h$ is the 3 dB bandwidth of the signals 642 and 644.

At the process 760, whether additional signal processing should be performed is determined. For example, the processes 730, 740 and 750 should be performed between the reference signal and each of all other signals. As another example, the processes 730, 740 and 750 should be performed between any two signals of the signals 642, 644, 646 and 648. In these two examples, if the processes 730, 740 and 750 are performed between signals 642 and 644 but not any other pair of signals, the process 760 determines additional signal processing should be performed.

If additional signal processing should be performed, some or all of the processes 710 through 760 are repeated. The process 710 may be skipped. For example, the signals 642 and 648 are selected and processed, the phase shifters 610 and 616 are adjusted, and the variable true time delay systems 630 and 636 are also adjusted. If additional signal processing does not need to be performed, the signal 641 is used as the output in the reception mode. If the time delay beam forming system 600 is configured to transmit signals, the signals 611, 613, 615 and 617 are used as the outputs in the transmission mode.

As discussed above and further emphasized here, FIG. 7 is merely an example, which should not unduly limit the scope of the claims. One of ordinary skill in the art would recognize many variations, alternatives, and modifications. For example, the method 700 also adjusts a phase shifter and a variable true time delay system corresponding to the selected reference signal.

Figure 9:
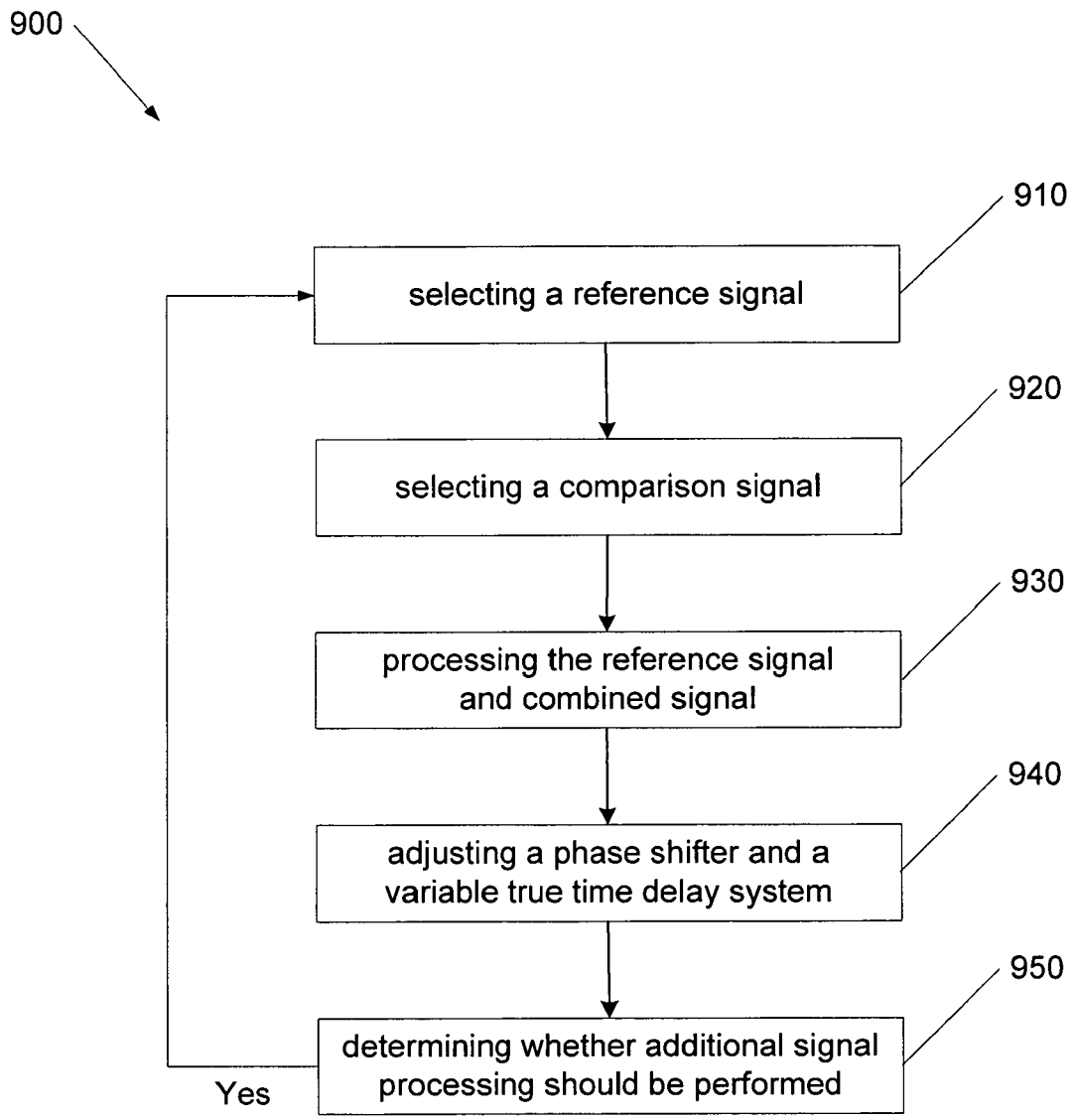
FIG. 9 is a simplified block diagram for an adaptive variable true time delay beam forming method according to one embodiment of the present invention.

FIG. 9 is a simplified block diagram for an adaptive variable true time delay beam forming method according to one embodiment of the present invention. This diagram is merely an example, which should not unduly limit the scope of the claims. One of ordinary skill in the art would recognize many variations, alternatives, and modifications. A time delay beam forming method 900 includes a process 910 for selecting a reference signal, a process 920 for selecting a comparison signal, a process 930 for processing the comparison signal and combined signal, a process 940 for adjusting a phase shifter and a variable true time delay system, and a process 950 for determining whether additional signal processing should be performed. Although the above has been shown using a selected sequence of processes, there can be many alternatives, modifications, and variations. For example, some of the processes may be expanded and/or combined. Other processes may be inserted to those noted above. Depending upon the embodiment, the specific sequence of steps may be interchanged with others replaced. Further details of these elements are found throughout the present specification and more particularly below.

At the process 910, a reference signal is selected from the signals 642, 644, 646 and 648. At the process 920, a comparison signal is selected from the signals 642, 644, 646 and 648. For example, the switch 662 receives the signals 642, 644, 646 and 648 and selects the signal 648 as its output signal 663. The switch 672 receives the signals 648 and 664 and selects the signal 648 as its output signal 673. The signal 648 is the comparison signal.

Figure 10:
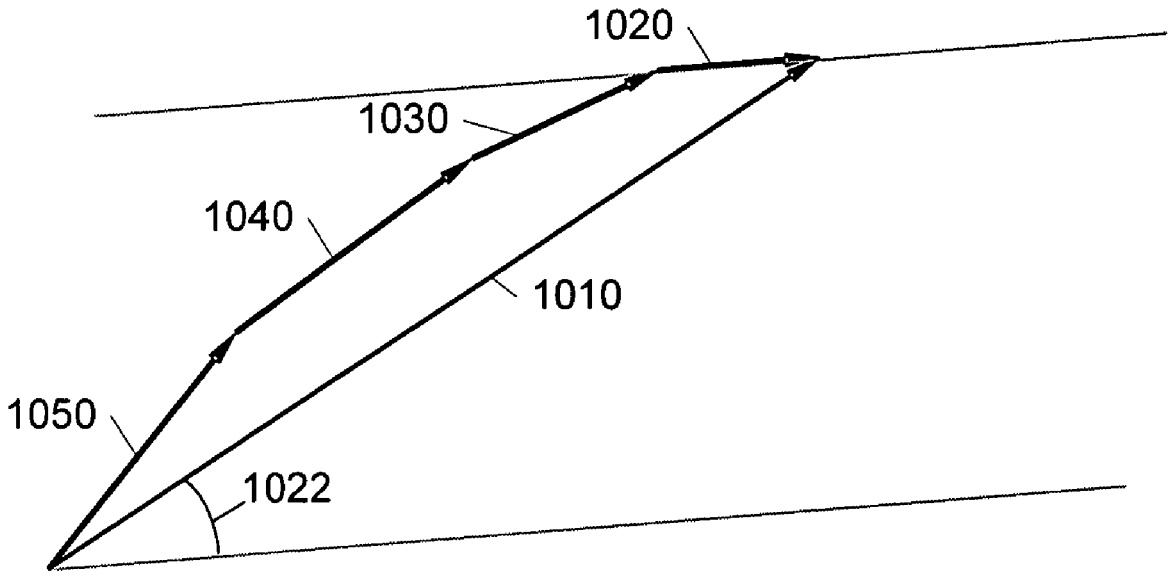
FIG. 10 is a simplified diagram for phase delay differences among signals according to one embodiment of the present invention.

At the process 930, the comparison signal and the combined signal are processed. For example, the switch 670 receives the signals 641 and 661 and selects the signal 641 as its output signal 671. The signal 641 is the combined signal. The correlative receiver 680 receives the signals 641 and 648 from the switches 670 and 672 respectively. The correlative receiver 680 processes the signals 641 and 648 and measures information related to their phase and time delay differences. FIG. 10 is a simplified diagram for phase differences among signals according to one embodiment of the present invention. This diagram is merely an example, which should not unduly limit the scope of the claims. One of ordinary skill in the art would recognize many variations, alternatives, and modifications. A vector 1010 represents the combined signal 641. The length of the vector 1010 represents the magnitude of the combined signal 641 and the direction of the vector 1010 represents the phase of the combined signal 641. Similarly, vectors 1020, 1030, 1040 and 1050 represent the signals 648, 646, 644 and 642 respectively. The vector lengths represent magnitudes of these signals and the vector directions represent phases of these signals respectively. An angle 1022 represents the phase difference between the combined signal 641 and the comparison signal 648.

Figure 11:
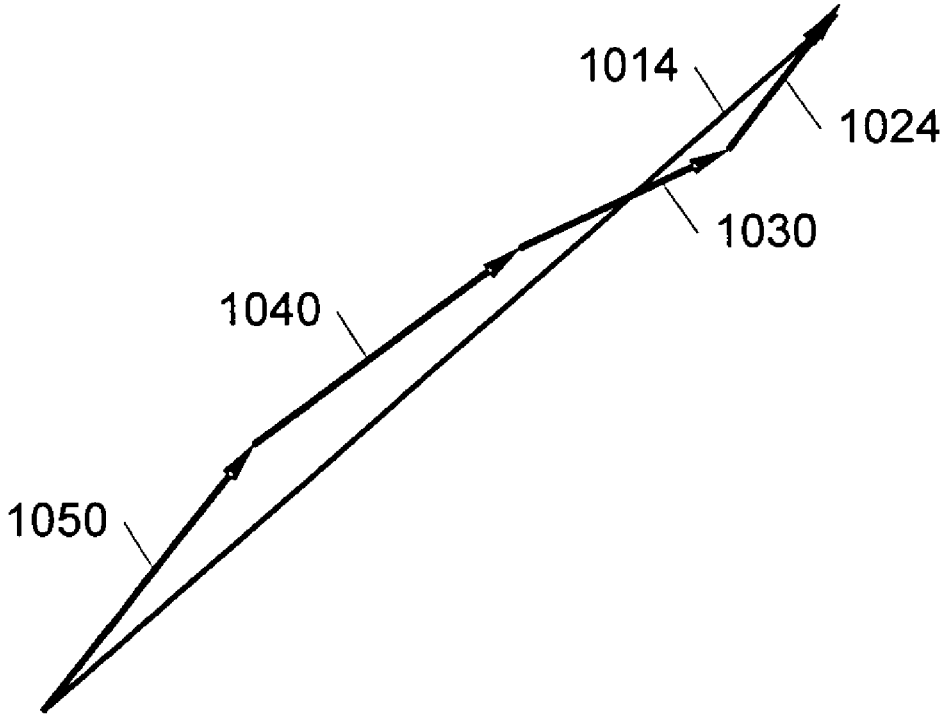
FIG. 11 is a simplified diagram for phase delay differences among signals with adjustments according to one embodiment of the present invention.

At the process 940, a phase shifter and a variable true time delay system are adjusted. The phase shifter and the variable true time delay system correspond to the comparison signal. For example, the phase shifter 616 and the variable true time delay system 636 corresponds to the signal 648. The phase shifter 616 and the variable true time delay system 636 are adjusted so that the phase difference between the signals 641 and 648, i.e., the angel 1022, is minimized. FIG. 11 is a simplified diagram for phase differences among signals with adjustments according to one embodiment of the present invention. This diagram is merely an example, which should not unduly limit the scope of the claims. One of ordinary skill in the art would recognize many variations, alternatives, and modifications. The vector 1020 is moved and rotated into a vector 1024. With the change to the vector 1020, the vector 1010 becomes a vector 1014. The vector 1014 is a sum of the vectors 1024, 1030, 1040 and 1050.

At the process 950, whether additional signal processing should be performed is determined. For example, the processes 930 and 940 should be performed between the combined signal and each of the divided signals other than the reference signal. The divided signals may include the signals 642, 644, 646 and 648. If the processes 930 and 940 are performed between signals 641 and 648 but not any other pair of signals, the process 950 determines additional signal processing should be performed.

Figure 12:
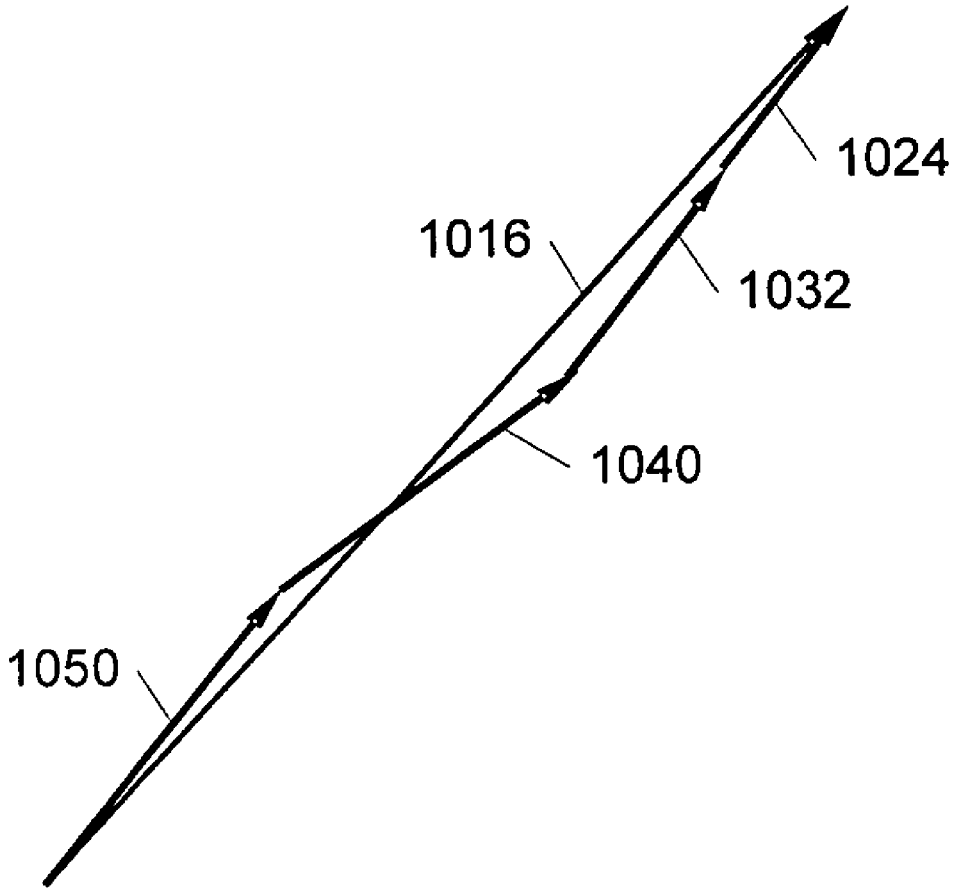
FIG. 12 is a simplified diagram for phase delay differences among signals with adjustments according to one embodiment of the present invention.

If additional signal processing should be performed, some or all of the processes 910 through 950 are repeated. The process 910 may be skipped. For example, the signal 642 remains as the reference signal, the signal 646 is selected as the comparison signal, the signals 641 and 646 are processed, the phase shifters 614 and the variable true time delay systems 634 are adjusted. FIG. 12 is a simplified diagram for phase differences among signals with adjustments according to one embodiment of the present invention. This diagram is merely an example, which should not unduly limit the scope of the claims. One of ordinary skill in the art would recognize many variations, alternatives, and modifications. The vector 1030 is moved and rotated into a vector 1032. With the change to the vector 1030, the vector 1014 becomes a vector 1016. The vector 1016 is a sum of the vectors 1024, 1032, 1040 and 1050.

Figure 13:
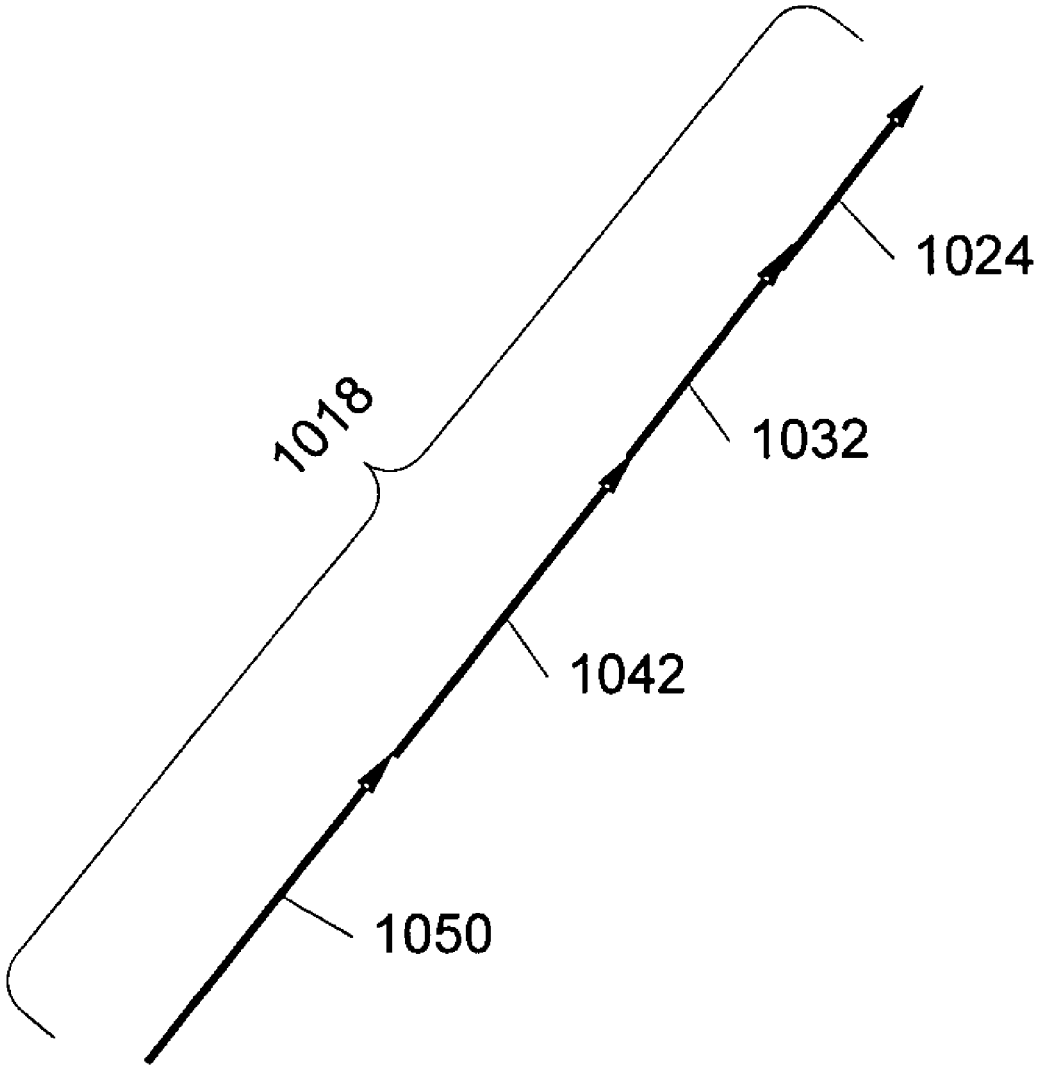
FIG. 13 is a simplified diagram for phase delay differences among signals with adjustments according to one embodiment of the present invention.

As another example, the signal 642 remains as the reference signal, the signal 644 is selected as the comparison signal, the signals 641 and 644 are processed, the phase shifters 612 and the variable true time delay systems 632 are adjusted. FIG. 13 is a simplified diagram for phase differences among signals with adjustments according to one embodiment of the present invention. This diagram is merely an example, which should not unduly limit the scope of the claims. One of ordinary skill in the art would recognize many variations, alternatives, and modifications. The vector 1040 is moved and rotated into a vector 1042. With the change to the vector 1040, the vector 1016 becomes a vector 1018. The vector 1018 is a sum of the vectors 1024, 1032, 1042 and 1050. As shown in FIG. 13, the vectors 1024, 1032, 1042 and 1050 have substantially the same direction.

If additional signal processing does not need to be performed, the signal 641 is used as the output in the reception mode. If the time delay beam forming system 600 is configured to transmit signals, the signals 611, 613, 615 and 617 are used as the outputs in the transmission mode.

As discussed above and further emphasized here, FIG. 9 is merely an example, which should not unduly limit the scope of the claims. One of ordinary skill in the art would recognize many variations, alternatives, and modifications. For example, the method 700 also adjusts a phase shifter and a variable true time delay system corresponding to the selected reference signal.

As shown in FIGS. 7 and 9, the time delay beam forming methods adjust and maintain the phase of a comparison signal to be substantially the same as the reference signal over a predetermined band of frequency. For example, the phases of the comparison signal and the reference signal are within ±10°. As a phased array antenna scans its beams, the phase difference between the comparison signal and the reference signal also changes. The adjustments of the phase shifter and the variable true time delay system should be fast enough to accommodate the dynamics of beam formation.

In one embodiment of the present invention, a phased array antenna system with the adaptive variable true time delay beam forming system 600 scans its beams at a rate of 2 degrees of elevation angle per second. The rate of change of the phase difference between two panel array antennas separated vertically by 75 inches is $$\Delta\Phi=2\pi\times D\times R\times\cos\theta/\lambda \qquad \text{(Equation 4)}$$

where $\Delta\Phi$ represents the rate of change of the phase difference, D represents the distance between two panel array antennas, R represents the rate of change of beam angle, $\theta$ represents the beam pointing angle, and $\lambda$ represents the wavelength of the beam signal. With D equal to 75 inches, R equal to 2 degrees per second, $\theta$ equal to zero degree, and $\lambda$ corresponding to 2.3 GHz, $\Delta\Phi$ equals about 183.5 degrees per second. In order to keep the phase difference between divided signals less than 10°, the phase adjustments should be performed once every about 50 msec.

Figure 14:
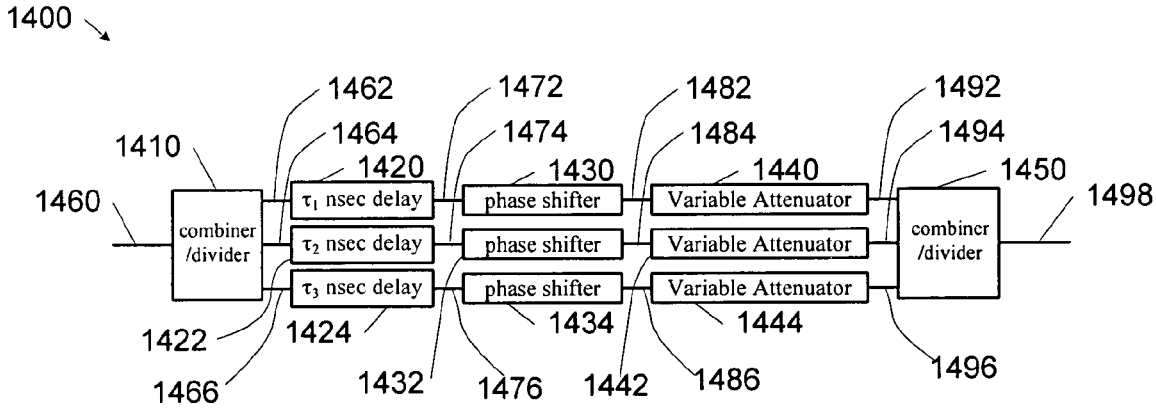
FIG. 14 is a simplified diagram for a variable true time delay system according to one embodiment of the present invention.

FIG. 14 is a simplified diagram for a variable true time delay system according to one embodiment of the present invention. This diagram is merely an example, which should not unduly limit the scope of the present invention. One of ordinary skill in the art would recognize many variations, alternatives, and modifications. A variable true time delay system 1400 includes a combiner and divider system 1410, time delay systems 1420, 1422 and 1424, phase shifters 1430, 1432 and 1434, variable attenuators 1440, 1442 and 1444, and a combiner and divider system 1450. Although the above has been shown using various systems, there can be many alternatives, modifications, and variations. For example, some of the systems may be expanded and/or combined. Additional time delay systems, phase shifters, and variable attenuators may be added to generate additional inputs to the combiner and divider system 1450, or receive additional outputs from the combiner and divider system 1450. Other systems may be inserted to those noted above. Depending upon the embodiment, the specific systems may be replaced. Further details of these systems are found throughout the present specification and more particularly below. The variable true time delay system 1400 may be used as each of the variable true time delay systems 630, 632, 634 and 636 as shown in FIG. 6.

The combiner and divider system 1410 receives a signal 1460 and generates signals 1462, 1464 and 1466 respectively. For example, the signal 1460 has a 3 dB bandwidth from $f_1$ to $f_h$. The time delay systems 1420, 1422 and 1466 receive the signals 1462, 1464 and 1466 and generate signals 1472, 1474 and 1476 respectively. For example, the time delay systems 1420, 1422 and 1426 include cables, optical fibers, or transmission lines respectively. The time delay systems 1420, 1422 and 1426 can provide predetermined time delays $\tau_1$, $\tau_2$ and $\tau_3$ respectively. The phase shifters 1430, 1432 and 1434 receive the signals 1472, 1474 and 1476 and generate signals 1482, 1484 and 1486 respectively. The variable attenuators 1440, 1442 and 1444 receives the signals 1482, 1484 and 1486 and generates signals 1492, 1494 and 1496 respectively. The combiner and divider system 1450 receives the signals 1492, 1494 and 1496 and generates a signal 1498. By controlling the attenuation levels of the variable attenuators 1440, 1442 and 1444, the effective time delay between the signal 1498 and the signal 1460 can be varied from the minimum of $\tau_1$, $\tau_2$ and $\tau_3$ to the maximum of $\tau_1$, $\tau_1$ and $\tau_3$ in a phase continuous manner. For example, the time differences between $\tau_1$, $\tau_2$ and $\tau_3$ are selected such that the phase differences over a frequency band from $f_1$ to $f_h$ between any one of the time delayed signals are small, such as less than 30 degrees. These selections are usually acceptable for beam-forming purpose without significant loss of signal processing gain.

In another embodiment, the combiner and divider system 1410 generates the signal 1460 and receives the signals 1462, 1464 and 1466 respectively. The time delay systems 1420, 1422 and 1466 generates the signals 1462, 1464 and 1466 and receive the signals 1472, 1474 and 1476 respectively. The time delay systems 1420, 1422 and 1426 can provide the predetermined time delays $\tau_1$, $\tau_2$ and $\tau_3$ respectively. The phase shifters 1430, 1432 and 1434 generate the signals 1472, 1474 and 1476 and receive the signals 1482, 1484 and 1486 respectively. The variable attenuators 1440, 1442 and 1444 generates the signals 1482, 1484 and 1486 and receives signals 1492, 1494 and 1496 respectively. The combiner and divider system 1450 generates the signals 1492, 1494 and 1496 and receives the signal 1498. By controlling the attenuation levels of the variable attenuators 1440, 1442 and 1444, the relative time delay between the signal 1460 and the signal 1498 can be varied from the minimum of $\tau_1$, $\tau_2$ and $\tau_3$ to the maximum of $\tau_1$, $\tau_1$ and $\tau_3$ in a phase continuous manner.

Figure 14A:
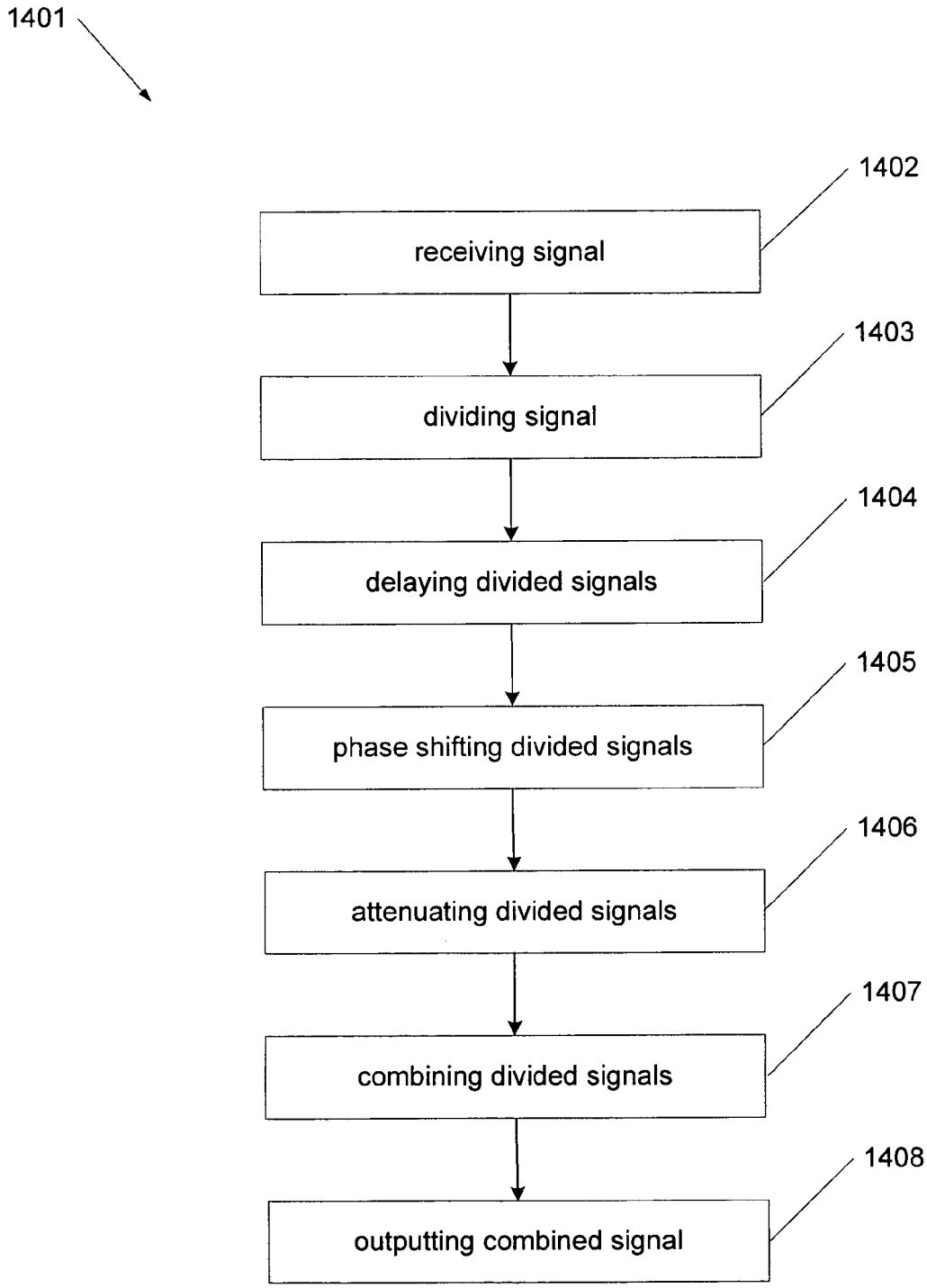
FIG. 14A is a simplified block diagram for a variable true time delay method according to one embodiment of the present invention.

FIG. 14A is a simplified block diagram for a variable true time delay method according to one embodiment of the present invention. This diagram is merely an example, which should not unduly limit the scope of the claims. One of ordinary skill in the art would recognize many variations, alternatives, and modifications. A variable true time delay method 1401 includes a process 1402 for receiving signal, a process 1403 for dividing signal, a process 1404 for delaying divided signals, a process 1405 for phase shifting divided signals, a process 1406 for attenuating divided signals, a process 1407 for combining divided signals, and a process 1408 for outputting combined signal. Although the above has been shown using a selected sequence of processes, there can be many alternatives, modifications, and variations. For example, the method 1401 can be modified for transmission mode. Some of the processes may be expanded and/or combined. Other processes may be inserted to those noted above. Depending upon the embodiment, the specific sequence of steps may be interchanged with others replaced. Further details of these elements are found throughout the present specification and more particularly below.

At the process 1402, the signal 1460 is received by the combiner and divider system 1410. At the process 1403, the combiner and divider system 1410 divides the signal 1460 into several signals, such as the signals 1462, 1464 and 1466. At the process 1404, the divided signals are delayed for the predetermined periods of time. For example, the signal 1462 is delayed by the time delay system 1420 by $\tau_1$ nsec. At the process 1405, the divided signals are phase shifted by the phase shifters 1430, 1432 and 1434. At the process 1406, the divided signals are attenuated by the variable attenuators 1440, 1442 and 1444. At the process 1407, the divided signals are combined by the combiner and divider system 1450. At the process 1408, a combined signal 1498 is generated.

Figure 14B:
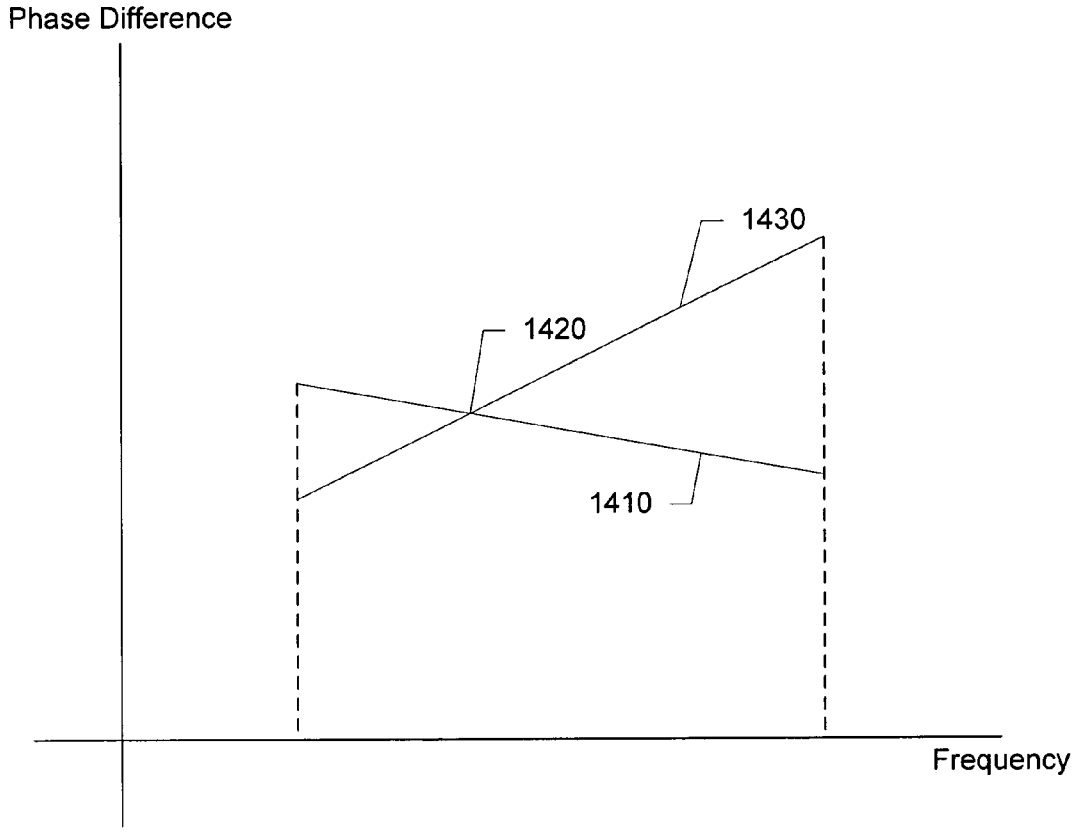
FIG. 14B is a simplified diagram for delaying signal according to an embodiment of the present invention.

For example, the method 1401 can rotate a frequency phase response around a pivot point. FIG. 14B is a simplified diagram for delaying signal according to an embodiment of the present invention. This diagram is merely an example, which should not unduly limit the scope of the claims. One of ordinary skill in the art would recognize many variations, alternatives, and modifications. A curve 1410 represents the phase difference between the signal 1460 and the signal 1498 as a function of frequency. The curve 1410 is substantially a straight line, and its slope represents a relative time delay between the two signals. The relative time delay is measured with respect to a reference time delay. By adjusting the phase shifters 1430, 1432 and 1434 and the variable attenuators 1440, 1442 and 1444 in the processes 1405 and 1406, the curve 1410 rotates around a point 1420 and becomes a curve 1430. Usually, the settings of the phase shifters 1430, 1432 and 1434 affect the location of the pivot point 1420 and the settings of the variable attenuators 1440, 1442 and 1444 affect the slope of the curve 1430. The slope of the curve 1430 is related to the relative time delay between the signal 1460 and the signal 1498.

Figure 15:
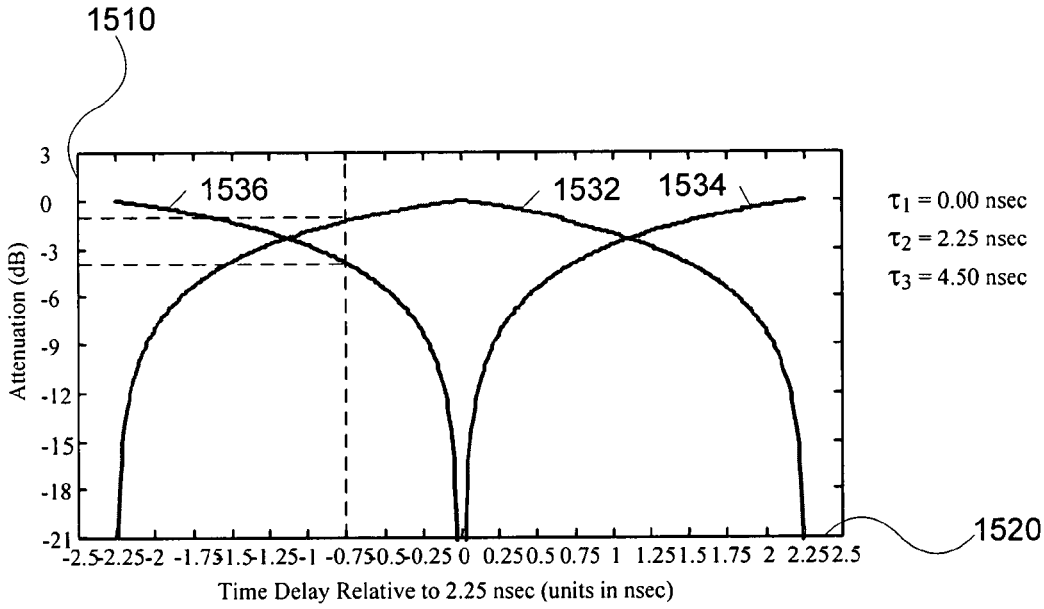
FIG. 15 is a simplified diagram for relative time delay as a function of attenuation levels according to an embodiment of the present invention.

FIG. 15 is a simplified diagram for relative time delay as a function of attenuation levels according to an embodiment of the present invention. This diagram is merely an example, which should not unduly limit the scope of the claims. One of ordinary skill in the art would recognize many variations, alternatives, and modifications. The time delay systems

1420, 1422 and 1426 provide the predetermined time delays $\tau_1$, $\tau_2$ and $\tau_3$ respectively, and $\tau_1$, $\tau_2$ and $\tau_3$ equal to 0.00, 2.25 and 4.50 nsec respectively. A vertical axis 1510 measures attenuation levels of the variable attenuators 1440, 1442 and 1444, and a horizontal axis 1520 measures relative time delay relative to $\tau_2$. Curves 1530, 1532 and 1534 represent the attenuation levels of the variable attenuators 1440, 1442 and 1444 corresponding to relative time delay values. For example, to achieve an relative time delay of −0.75 nsec, the attenuation levels of the variable attenuators 1440, 1442 and 1444 should be adjusted to about −4 dB, −1 dB, and less than −21 dB respectively.

According to an embodiment of the present invention, the design of a variable true time delay system is explained as follows. One of ordinary skill in the art would recognize many variations, alternatives, and modifications. The variable true time delay system is designed to provide a phase delay of $\phi=2\times\pi\times\tau\times f$ radian, where $\tau$ denotes an relative time delay, and $f=f_1$, $f_2$, or $f_3$ within a bandwidth from $f_1$ to $f_h$. The center of $f_1$ and $f_h$ is denoted by $f_o$.

For example, the variable true time delay system 1400 is designed. The variable true time delay system 1400 has signal channels 1, 2 and 3 corresponding to the signals 1462, 1464 and 1466 respectively. To describe the operation of the system 1400 based on two signal channels, one of the three channels is assumed to have its variable attenuator programmed at the maximum attenuation.

The transfer function of the system 1400 is represented by $$a_1{}^*\exp\{j\phi_o+j2\pi\tau_1 f+j\phi_1\}+a_2{}^*\exp\{+j\phi_o+j\pi\tau_2 f+j\phi_2\}=\exp\{j\phi_o+j2\pi\tau_2 f\}\times[a_2\exp\{j\phi_2\}+a_1\exp\{j2\pi(\tau_1-\tau_2)f+j\phi_1\}] \quad \text{(Equation 5)}$$

$$a_2{}^*\exp\{j\phi_o+j2\pi\tau_2 f+j\phi_2\}+a_3{}^*\exp\{+j\phi_o+j\pi\tau_3 f+j\phi_3\}=\exp\{j\phi_o+j2\pi\tau_2 f\}\times[a_2\exp\{j\phi_2\}+a_3\exp\{j2\pi(\tau_3-\tau_2)f+j\phi_3\}] \quad \text{(Equation 6)}$$

where $a_1$, $a_2$ and $a_3$ denote the amplitudes of the signals in signal channels 1, 2 and 3, $\phi_o$ represents the value of the common phase delay, $\tau_1$, $\tau_2$ and $\tau_3$ represents the time delays in signal channels 1, 2 and 3, and $\phi_1$, $\phi_2$ & $\phi_3$ represents the phase delays in channels 1, 2 and 3 respectively. For example, $a_1$, $a_2$ and $a_3$ are determined at least in part by the variable attenuators 1440, 1442 and 1444. As another example, $\tau_2-\tau_{1=2.25}$ nsec and $\tau_3-\tau_{2=2.25}$ nsec.

The variable true time delay system 1400 has three frequency calibration points, 2.25, 2.30 and 2.35 GHz. At a calibrated frequency point $f_o$, the system is calibrated to produce $\phi_2=0$, and the phase shifters of channels 1 and 3 are calibrated such that $2\pi(\tau_2-\tau_1)f_o+\phi_1=2\pi(\tau_3-\tau_2)f_o+\phi_3$ equal an integral multiple of $2\pi$. Therefore, the expressions for the transfer function of the variable time delay system become $\exp\{j\phi_o+j2\pi\tau_2(f_o+\Delta f)\}\times[a_2+a_1\exp\{-j2\pi(\tau_2-\tau_2)\Delta f\}]$ or $\exp\{j\phi_o+j2\pi\tau_2(f_o+\Delta f)\}\times[a_2+a_3\exp\{j2\pi(\tau_3-\tau_2)\Delta f\}]$ where $f=f_o+\Delta f$.

For example, the calibrated values of $\phi_1$ and $\phi_3$ are show in Table 1. The values for $\phi_1$ and $\phi_3$ may be different from ones listed in Table 1 due to differences in cable lengths used for time delays systems in various signal channels.

TABLE 1

| Calibration frequency | $\phi_1$ (degrees) | $\phi_3$ (degrees) |
|---|---|---|
| 2250.0 MHz | −22.5 | −22.5 |
| 2300.0 MHz | −63.0 | −63.0 |
| 2350.0 MHz | −103.5 | −103.5 |

The theoretical transmission coefficient $s_{21}$ for the system 1400 is described in Tables 2 and 3 as a function of $a_1$, $a_2$ and $a_3$. The transmission coefficient also varies with frequency measured from the center frequency $f_0$. For example, $f_o$ equals 2250, 2300 or 2350 MHz. For each combination of $a_1$, $a_2$ and $a_3$, $s_{21}$ is listed for the relative frequency values of −50, −40, −30, −20, −10, 0, 10, 20, 30, 40 and 50 MHz, and the relative frequency values are measured with respect to the center frequency $f_0$. The magnitude of $s_{21}$ is described in Table 2, and the phase of $s_{21}$ in degrees is described in Table 3. The system 1400 has an electrical length compensation of $\tau_2$ and a phase compensation of $\phi_o$.

TABLE 2

| | $a_1$ | $a_2$ | $a_3$ | −50 | −40 | −30 | −20 | −10 | 0 | 10 | 20 | 30 | 40 | 50 |
|---|---|---|---|---|---|---|---|---|---|---|---|---|---|---|
| 1 | 0.88 | 0.00 | 0.00 | 0.88 | 0.88 | 0.88 | 0.88 | 0.88 | 0.88 | 0.88 | 0.88 | 0.88 | 0.88 | 0.88 |
| 2 | 0.87 | 0.10 | 0.00 | 0.95 | 0.96 | 0.96 | 0.97 | 0.97 | 0.97 | 0.97 | 0.97 | 0.96 | 0.96 | 0.95 |
| 3 | 0.86 | 0.20 | 0.00 | 1.02 | 1.03 | 1.04 | 1.05 | 1.06 | 1.06 | 1.06 | 1.05 | 1.04 | 1.03 | 1.02 |
| 4 | 0.84 | 0.30 | 0.00 | 1.08 | 1.10 | 1.12 | 1.13 | 1.13 | 1.14 | 1.13 | 1.13 | 1.12 | 1.10 | 1.08 |
| 5 | 0.80 | 0.40 | 0.00 | 1.14 | 1.16 | 1.18 | 1.19 | 1.20 | 1.20 | 1.20 | 1.19 | 1.18 | 1.16 | 1.14 |
| 6 | 0.76 | 0.50 | 0.00 | 1.19 | 1.21 | 1.23 | 1.25 | 1.26 | 1.26 | 1.26 | 1.25 | 1.23 | 1.21 | 1.19 |
| 7 | 0.70 | 0.60 | 0.00 | 1.22 | 1.25 | 1.27 | 1.29 | 1.30 | 1.30 | 1.30 | 1.29 | 1.27 | 1.25 | 1.22 |
| 8 | 0.63 | 0.70 | 0.00 | 1.24 | 1.27 | 1.30 | 1.31 | 1.32 | 1.33 | 1.32 | 1.31 | 1.30 | 1.27 | 1.24 |
| 9 | 0.53 | 0.80 | 0.00 | 1.25 | 1.28 | 1.30 | 1.31 | 1.32 | 1.33 | 1.32 | 1.31 | 1.30 | 1.28 | 1.25 |
| 10 | 0.38 | 0.90 | 0.00 | 1.22 | 1.24 | 1.26 | 1.27 | 1.28 | 1.28 | 1.28 | 1.27 | 1.26 | 1.24 | 1.22 |
| 11 | 0 | 1 | 0 | 1 | 1 | 1 | 1 | 1 | 1 | 1 | 1 | 1 | 1 | 1 |
| 12 | 0.00 | 0.90 | 0.38 | 1.22 | 1.24 | 1.26 | 1.27 | 1.28 | 1.28 | 1.28 | 1.27 | 1.26 | 1.24 | 1.22 |
| 13 | 0.00 | 0.80 | 0.53 | 1.25 | 1.28 | 1.30 | 1.31 | 1.32 | 1.33 | 1.32 | 1.31 | 1.30 | 1.28 | 1.25 |
| 14 | 0.00 | 0.70 | 0.63 | 1.24 | 1.27 | 1.30 | 1.31 | 1.32 | 1.33 | 1.32 | 1.31 | 1.30 | 1.27 | 1.24 |
| 15 | 0.00 | 0.60 | 0.70 | 1.22 | 1.25 | 1.27 | 1.29 | 1.30 | 1.30 | 1.30 | 1.29 | 1.27 | 1.25 | 1.22 |
| 16 | 0.00 | 0.50 | 0.76 | 1.19 | 1.21 | 1.23 | 1.25 | 1.26 | 1.26 | 1.26 | 1.25 | 1.23 | 1.21 | 1.19 |
| 17 | 0.00 | 0.40 | 0.80 | 1.14 | 1.16 | 1.18 | 1.19 | 1.20 | 1.20 | 1.20 | 1.19 | 1.18 | 1.16 | 1.14 |
| 18 | 0.00 | 0.30 | 0.84 | 1.08 | 1.10 | 1.12 | 1.13 | 1.13 | 1.14 | 1.13 | 1.13 | 1.12 | 1.10 | 1.08 |
| 19 | 0.00 | 0.20 | 0.86 | 1.02 | 1.03 | 1.04 | 1.05 | 1.06 | 1.06 | 1.06 | 1.05 | 1.04 | 1.03 | 1.02 |
| 20 | 0.00 | 0.10 | 0.87 | 0.95 | 0.96 | 0.96 | 0.97 | 0.97 | 0.97 | 0.97 | 0.97 | 0.96 | 0.96 | 0.95 |
| 21 | 0.00 | 0.00 | 0.88 | 0.88 | 0.88 | 0.88 | 0.88 | 0.88 | 0.88 | 0.88 | 0.88 | 0.88 | 0.88 | 0.88 |

TABLE 3

| | $a_1$ | $a_2$ | $a_3$ | −50 | −40 | −30 | −20 | −10 | 0 | 10 | 20 | 30 | 40 | 50 | delay |
|---|---|---|---|---|---|---|---|---|---|---|---|---|---|---|---|
| 1 | 0.88 | 0.00 | 0.00 | 40.50 | 32.40 | 24.30 | 16.20 | 8.10 | 0.00 | −8.10 | −16.20 | −24.30 | −32.40 | −40.50 | −2.25 |
| 2 | 0.87 | 0.10 | 0.00 | 36.58 | 29.20 | 21.86 | 14.55 | 7.27 | 0.00 | −7.27 | −14.55 | −21.86 | −29.20 | −36.58 | −2.03 |
| 3 | 0.86 | 0.20 | 0.00 | 33.18 | 26.45 | 19.78 | 13.16 | 6.57 | 0.00 | −6.57 | −13.16 | −19.78 | −26.45 | −33.18 | −1.84 |
| 4 | 0.84 | 0.30 | 0.00 | 30.13 | 24.01 | 17.95 | 11.94 | 5.96 | 0.00 | −5.96 | −11.94 | −17.95 | −24.01 | −30.13 | −1.67 |
| 5 | 0.80 | 0.40 | 0.00 | 27.31 | 21.77 | 16.28 | 10.83 | 5.41 | 0.00 | −5.41 | −10.83 | −16.28 | −21.77 | −27.31 | −1.52 |
| 6 | 0.76 | 0.50 | 0.00 | 24.60 | 19.63 | 14.69 | 9.78 | 4.89 | 0.00 | −4.89 | −9.78 | −14.69 | −19.63 | −24.60 | −1.37 |
| 7 | 0.70 | 0.60 | 0.00 | 21.90 | 17.50 | 13.11 | 8.74 | 4.37 | 0.00 | −4.37 | −8.74 | −13.11 | −17.50 | −21.90 | −1.22 |
| 8 | 0.63 | 0.70 | 0.00 | 19.08 | 15.28 | 11.47 | 7.65 | 3.83 | 0.00 | −3.83 | −7.65 | −11.47 | −15.28 | −19.08 | −1.06 |
| 9 | 0.53 | 0.80 | 0.00 | 15.90 | 12.77 | 9.61 | 6.42 | 3.21 | 0.00 | −3.21 | −6.42 | −9.61 | −12.77 | −15.90 | −0.88 |
| 10 | 0.38 | 0.90 | 0.00 | 11.78 | 9.51 | 7.18 | 4.81 | 2.41 | 0.00 | −2.41 | −4.81 | −7.18 | −9.51 | −11.78 | −0.65 |
| 11 | 0 | 1 | 0 | 0 | 0 | 0 | 0 | 0 | 0 | 0 | 0 | 0 | 0 | 0 | 0 |
| 12 | 0.00 | 0.90 | 0.38 | −11.78 | −9.51 | −7.18 | −4.81 | −2.41 | 0.00 | 2.41 | 4.81 | 7.18 | 9.51 | 11.78 | 0.65 |
| 13 | 0.00 | 0.80 | 0.53 | −15.90 | −12.77 | −9.61 | −6.42 | −3.21 | 0.00 | 3.21 | 6.42 | 9.61 | 12.77 | 15.90 | 0.88 |
| 14 | 0.00 | 0.70 | 0.63 | −19.08 | −15.28 | −11.47 | −7.65 | −3.83 | 0.00 | 3.83 | 7.65 | 11.47 | 15.28 | 19.08 | 1.06 |
| 15 | 0.00 | 0.60 | 0.70 | −21.90 | −17.50 | −13.11 | −8.74 | −4.37 | 0.00 | 4.37 | 8.74 | 13.11 | 17.50 | 21.90 | 1.22 |
| 16 | 0.00 | 0.50 | 0.76 | −24.60 | −19.63 | −14.69 | −9.78 | −4.89 | 0.00 | 4.89 | 9.78 | 14.69 | 19.63 | 24.60 | 1.37 |
| 17 | 0.00 | 0.40 | 0.80 | −27.31 | −21.77 | −16.28 | −10.83 | −5.41 | 0.00 | 5.41 | 10.83 | 16.28 | 21.77 | 27.31 | 1.52 |
| 18 | 0.00 | 0.30 | 0.84 | −30.13 | −24.01 | −17.95 | −11.94 | −5.96 | 0.00 | 5.96 | 11.94 | 17.95 | 24.01 | 30.13 | 1.67 |
| 19 | 0.00 | 0.20 | 0.86 | −33.18 | −26.45 | −19.78 | −13.16 | −6.57 | 0.00 | 6.57 | 13.16 | 19.78 | 26.45 | 33.18 | 1.84 |
| 20 | 0.00 | 0.10 | 0.87 | −36.58 | −29.20 | −21.86 | −14.55 | −7.27 | 0.00 | 7.27 | 14.55 | 21.86 | 29.20 | 36.58 | 2.03 |
| 21 | 0.00 | 0.00 | 0.88 | −40.50 | −32.40 | −24.30 | −16.20 | −8.10 | 0.00 | 8.10 | 16.20 | 24.30 | 32.40 | 40.50 | 2.25 |

In Table 3, the last column of data indicates the time delay relative to $\tau_2$ for the system 1400. For example, $\tau_2$ equals 2.25 nsec. Additional optimization on the parameters $a_1$, $a_2$ and $a_3$ is required to obtain magnitude responses closer to unity. It should be pointed out that the effectiveness of the variable time delay system in terms of providing the desirable phase is usually tolerant of small errors in its time delay. For example, an relative time delay error of 0.25 nsec translates into a maximum phase error of less than 4.5 degrees within 50 MHz of the calibration point.

Figure 16:
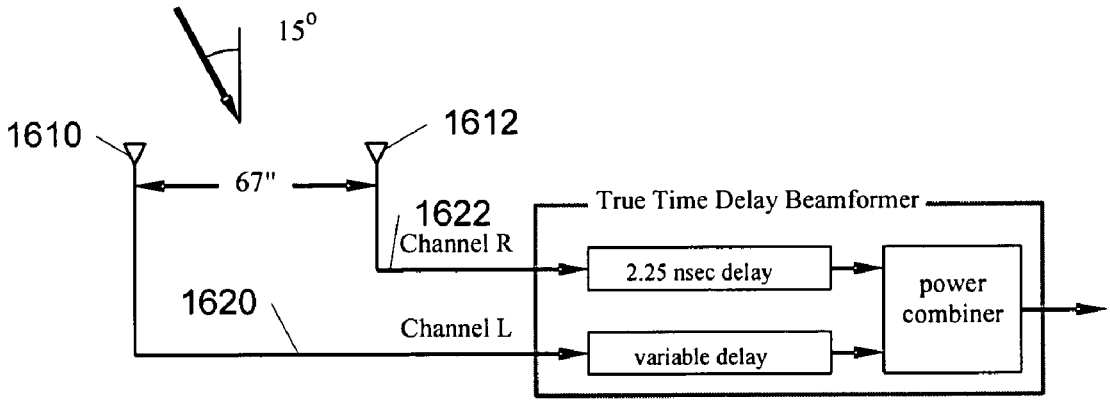
FIG. 16 is a simplified block diagram for an antenna system according to one embodiment of the present invention.

FIG. 16 is a simplified block diagram for an antenna system according to one embodiment of the present invention. This diagram is merely an example, which should not unduly limit the scope of the present invention. One of ordinary skill in the art would recognize many variations, alternatives, and modifications. As shown in FIG. 16, two antennas 1610 and 1612 are separated by a horizontal baseline distance of L equal to 67". These antennas 1610 and 1612 correspond to signal channels 1620 and 1622 respectively. The signal channels 1620 and 1622 are also called Channel R and Channel L respectively. The arriving signals are two telemetry links, narrow band signals centered at 2200.5 MHz and 2275.5 MHz. The incident angle is $\theta_{inc}$=15 degree relative to antenna baseline normal. The time difference of arrival is $\Delta\tau=(L \sin \theta_{inc})/c$, where c is the speed of light. For a 15 degree incident angle, $\Delta\tau$=1.4682 nsec.

Figure 17:
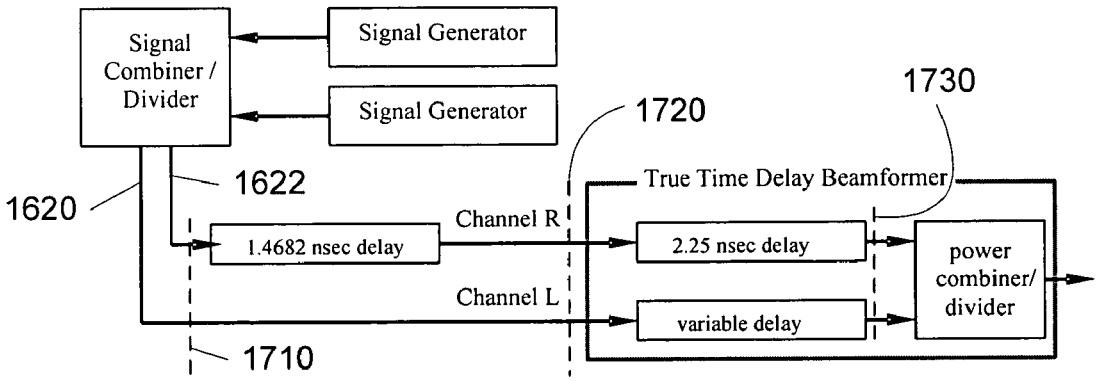
FIG. 17 is a simplified circuit diagram for an antenna system as describe in FIG. 16 according to one embodiment of the present invention.

FIG. 17 is a simplified circuit diagram for an antenna system as describe in FIG. 16 according to one embodiment of the present invention. This diagram is merely an example, which should not unduly limit the scope of the present invention. One of ordinary skill in the art would recognize many variations, alternatives, and modifications. At a cross section 1710, the signals at Channel L and Channel R are both expressed by $x_1(t)+x_2(t)$, where $x_1(t)$ and $x_2(t)$ denote the telemetry links. At a cross section 1720, the signal at Channel L is expressed by $x_1(t)+x_2(t)$, and the signal at Channel R is expressed by $$x_1(t)\exp\{j*2\pi*\Delta\tau*f_1\}+x_2(t)\exp\{j*2\pi*\Delta\tau*f_2\}= \quad \text{(Equation 7)}$$
$$x_1(t)\exp\{j\xi_1\}+x_2(t)\exp\{j\xi_2\}=$$
$$x_1(t)\exp\{j65.48°\}+x_2(t)\exp\{j165.87°\}$$

where $\Delta\Sigma$=1.4682 nsec, $f_{1=2200.5}$ MHz, and $f_{2=2275.5}$ MHz. The signal at Channel R can be approximated to $$x_1(t)\exp\{j\phi_o+j2\pi\tau_2 f_1\}\times[a_2+a_3\exp\{j2\pi(\tau_3-\tau_2)\Delta f_1\}]+ x_2(t)\exp\{j\phi_o+j2\pi\tau_2 f_2\}\times[a_2+ a_3\exp\{j2\pi(\tau_3-\tau_2)\Delta_2\}] \quad \text{(Equation 8)}$$

where $\Delta f_1$=−49.5 MHz, and $\Delta f_{2=25.5}$ MHz. With $\phi_o$=22.50, $a_{2=0.5}$, and $a_{3=0.76}$, the signal at Channel R can be further approximated to $$1.25*x_1(t)\exp\{j65.36°\}+1.06*x_2(t)\exp\{j163.56°\} \quad \text{(Equation 9)}$$

Equations 7 and 9 shows that for both telemetry links the signal in Channel L is close to being in phase with the signal in Channel R. As shown in FIG. 17, at a cross section 1730, the signals at Channel L and Channel R channel are both expressed by $x_1(t)\exp\{j*2\pi*(\Delta\tau+\tau_2)*f_1\}+x_2(t)\exp\{j*2\pi*(\Delta\tau+\tau_2)*f_2\}$, where $\Delta\tau$=1.4682 nsec, $\tau_{2=2.25}$ nsec, $f_{1=2200.5}$ MHz, and $f_{2=2275.5}$ MHz.

Figure 18:
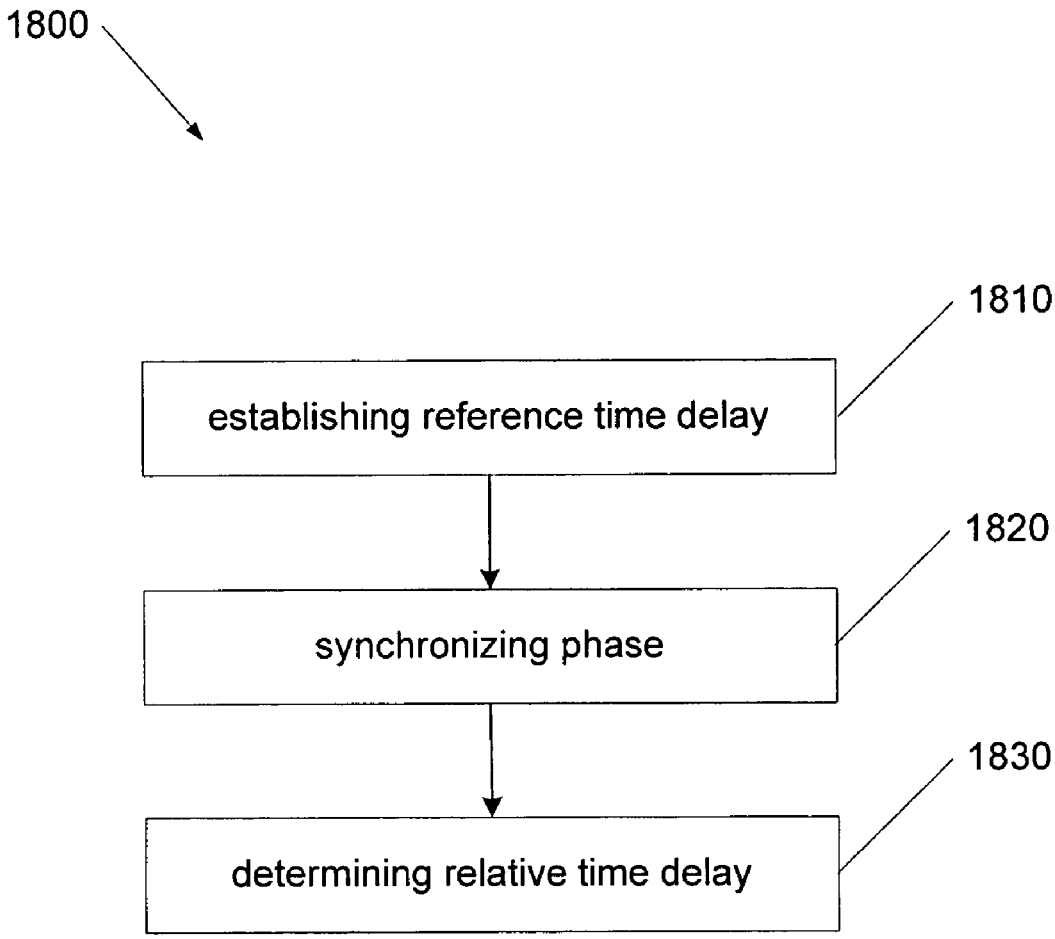
FIG. 18 is a simplified block diagram for a method of calibrating a variable true time delay system according to one embodiment of the present invention.

FIG. 18 is a simplified block diagram for a method of calibrating a variable true time delay system according to one embodiment of the present invention. This diagram is merely an example, which should not unduly limit the scope of the claims. One of ordinary skill in the art would recognize many variations, alternatives, and modifications. A calibrating method 1800 includes a process 1810 for establishing reference time delay, a process 1820 for phase synchronization, a process 1830 for determining relative time delay. Although the above has been shown using a selected sequence of processes, there can be many alternatives, modifications, and variations. For example, some of the processes may be expanded and/or combined. Other processes may be inserted to those noted above. Depending upon the embodiment, the specific sequence of steps may be interchanged with others replaced. Further details of these elements are found throughout the present specification and more particularly below.

At the process 1810, a reference time delay is established in a network analyzer. The network analyzer is connected between the combiner and divider systems 1410 and 1450. The network analyzer sends the signal 1460 to the combiner and divider system 1410 and receivers the signal 1498 from the combiner and divider system 1450. The time delay systems 1420, 1422 and 1424 provide the predetermined delays $\tau_1$, $\tau_2$ and $\tau_3$ respectively. The minimum of $\tau_1$, $\tau_2$ and $\tau_3$ is $\tau_{min}$, the maximum of $\tau_1$, $\tau_2$ and $\tau_3$ is $\tau_{max}$, and the middle value of $\tau_1$, $\tau_2$ and $\tau_3$ is $\tau_{mid}$. The phase shifter associated with $\tau_{mid}$ is adjusted to a mid-point value in terms of the total range of phase shift, and the variable attenuator associated with $\tau_{mid}$ is set to the minimum attenuation. The other two variable attenuators are set to the maximum attenuation. For example, $\tau_2$ equals $\tau_{mid}$. The phase shifter and the variable attenuator associated with $\tau_{mid}$ are the phase shifter 1432 and the variable attenuator 1442. The network analyzer is set to measure the transmission coefficient $S_{21}$ of the variable true time delay system 1400 over a frequency band from $f_1$, to $f_h$. $S_{21}$ equals a ratio of the signal 1498 to the signal 1460, and is a complex number with magnitude and phase. Based on the measured magnitude and phase, the network analyzer establishes the reference time delay and phase offset. The reference time delay is used to determined a relative time delay. A time delay equal to the reference time delay has a zero relative time delay. Optionally, the network analyzer may set data averaging factor to 64, use aperture smoothing factor of 10%.

At the process 1820, phase synchronization is performed. When the phases are synchronized, the relative phases of the signals 1492, 1494 and 1496 through the three signal channels are the same at a predetermined frequency. This predetermined frequency corresponds to the pivot point 822 in FIG. 8 and the pivot point 1420 in FIG. 14B. For example, the control voltages for the phase shifters associated with $\tau_{min}$ and $\tau_{max}$ are adjusted to achieve phase synchronization between each of these two signal channels and the $\tau_{mid}$ signal channel at the predetermined frequency. The predetermined frequency may equal to 2.22 GHz, 2.26 GHz, 2.30 GHz, 2.34 GHz, 2.38 GHz or other value. The control voltage values for phase synchronization may be stored in a table similar to Table 4. Table 4 is merely an example, which should not unduly limit the scope of the claims. One of ordinary skill in the art would recognize many variations, alternatives, and modifications.

TABLE 4

| | 2.22 GHz | 2.26 GHz | 2.30 GHz | 2.34 GHz | 2.38 G |
|---|---|---|---|---|---|
| $\tau_1$ | $V_{11}$ | $V_{12}$ | $V_{13}$ | $V_{14}$ | $V_{15}$ |
| $\tau_2$ | $V_{21}$ | $V_{22}$ | $V_{23}$ | $V_{24}$ | $V_{25}$ |
| $\tau_3$ | $V_{31}$ | $V_{32}$ | $V_{33}$ | $V_{34}$ | $V_{35}$ |

At the process 1830, the relative time delay is determined. The control voltages for the variable attenuators 1440, 1442 and 1444 are adjusted with the variable true time delay system 1400 remains phase synchronized at the predetermined frequency. The network analyzer measures the transmission coefficient $S_{21}$ of the system 1400 as a function of the control voltages. Based on the measured $S_{21}$, the effective attenuation and the relative time delay are determined with respect to the reference time delay established in the process 1810. These data can be compiled into a table similar to Table 5. Table 5 is merely an example, which should not unduly limit the scope of the claims. One of ordinary skill in the art would recognize many variations, alternatives, and modifications. For relative time delays at every 0.2 nsec between the range of $\tau_{min}$ and $\tau_{max}$, the values of control voltages can be determined for a predetermined pivot point frequency. $\tau_{min}$ and $\tau_{max}$ are associated with having the $\tau_{min}$ signal channel and the $\tau_{max}$ signal channel being active by themselves one at a time.

TABLE 5

| | $\tau_{max}$ | $\tau_{mid}$ | $\tau_{min}$ | Attenuation (dB) | Delay (nsec) |
|---|---|---|---|---|---|
| 1 | $V_{11}$ | $V_{12}$ | $V_{13}$ | $Atten_1$ | $Delay_1$ |
| 2 | $V_{21}$ | $V_{22}$ | $V_{23}$ | $Atten_2$ | $Delay_2$ |
| 3 | $V_{31}$ | $V_{32}$ | $V_{33}$ | $Atten_3$ | $Delay_3$ |
| 4 | $V_{41}$ | $V_{42}$ | $V_{43}$ | $Atten_4$ | $Delay_4$ |
| 5 | $V_{51}$ | $V_{52}$ | $V_{53}$ | $Atten_5$ | $Delay_5$ |
| . . . | . . . | . . . | . . . | . . . | . . . |
| 25 | $V_{251}$ | $V_{252}$ | $V_{253}$ | $Atten_{25}$ | $Delay_{25}$ |
| 26 | $V_{261}$ | $V_{262}$ | $V_{263}$ | $Atten_{26}$ | $Delay_{26}$ |
| 27 | $V_{271}$ | $V_{272}$ | $V_{273}$ | $Atten_{27}$ | $Delay_{27}$ |
| 28 | $V_{281}$ | $V_{282}$ | $V_{283}$ | $Atten_{28}$ | $Delay_{28}$ |

As discussed above and further emphasized here, FIG. 18 is merely an example, which should not unduly limit the scope of the claims. One of ordinary skill in the art would recognize many variations, alternatives, and modifications. The attenuation corresponding to the variable attenuator set to minimum attenuation may be determined for each signal channel at each pivot point frequency. For example, the minimum attenuation corresponding to the $\tau_1$ signal channel may be determined by setting the variable attenuator 1440 to minimum attenuation and setting the variable attenuators 1442 and 1444 to maximum attenuations. The time delays may be measured for each signal channel at each pivot point frequency. For example, the time delay is measured for the $\tau_1$ signal channel by setting the variable attenuator 1440 to minimum attenuation and setting the variable attenuators 1442 and 1444 to maximum attenuations.

Figure 19:
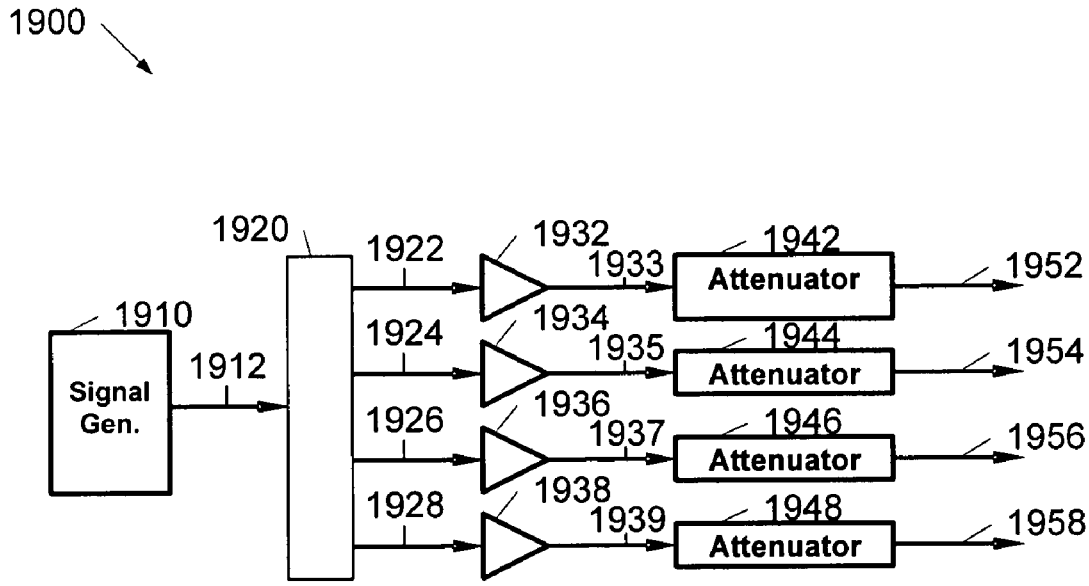
FIG. 19 is a simplified diagram for a calibrating system for an adaptive variable true time delay beam forming system according to one embodiment of the present invention.

FIG. 19 is a simplified diagram for a calibrating system for an adaptive variable true time delay beam forming system according to one embodiment of the present invention. This diagram is merely an example, which should not unduly limit the scope of the present invention. One of ordinary skill in the art would recognize many variations, alternatives, and modifications. A calibrating system 1900 includes a signal generator 1910, a divider system 1920, amplifiers 1932, 1934, 1936 and 1938, and attenuators 1942, 1944, 1946 and 1948. Although the above has been shown using various systems, there can be many alternatives, modifications, and variations. For example, some of the systems may be expanded and/or combined. The combiner system 1920 may generate more or less than four output signals. Additional amplifiers and attenuators may be added to generate additional output signals. Other systems may be inserted to those noted above. Depending upon the embodiment, the specific systems may be replaced. Further details of these systems are found throughout the present specification and more particularly below.

The signal generator 1910 generates a signal 1912 at a predetermined frequency. The signal 1912 is received by the divider system 1920 and divided into signals 1922, 1924, 1926 and 1928. The signals 1922, 1924, 1926 and 1928 are received by the amplifiers 1932, 1934, 1936 and 1938 respectively, which generate signals 1933, 1935, 1937 and 1939 respectively. For example, the amplifiers are set at a gain of 30 dB and the attenuators are set at an attenuation of 6 dB. The signals 1933, 1935, 1937 and 1939 have substantially the same relative phase and the same relative time delay. Additionally, the signals 1933, 1935, 1937 and 1939 have substantially the same magnitude with different random noises.

Figure 20:
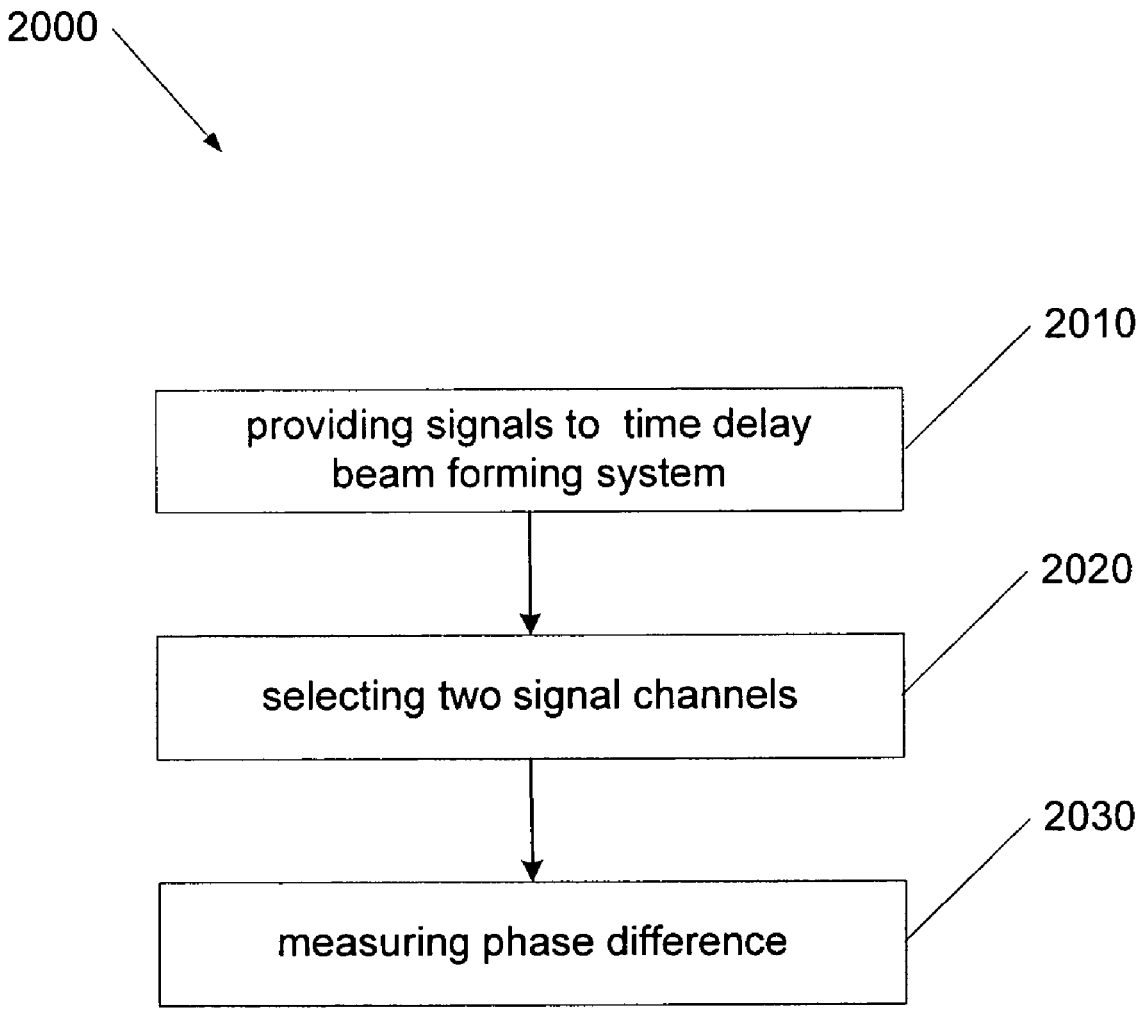
FIG. 20 is a simplified block diagram for a method of calibrating an adaptive variable true time delay beam forming system according to one embodiment of the present invention.

FIG. 20 is a simplified block diagram for a method of calibrating an adaptive variable true time delay beam forming system according to one embodiment of the present invention. This diagram is merely an example, which should not unduly limit the scope of the claims. One of ordinary skill in the art would recognize many variations, alternatives, and modifications. A calibrating method 2000 includes a process 2010 for providing signals to time delay beam forming system, a process 2020 for selecting two signal channels, and a process 2030 for measuring phase difference. Although the above has been shown using a selected sequence of processes, there can be many alternatives, modifications, and variations. For example, some of the processes may be expanded and/or combined. Other processes may be inserted to those noted above. Depending upon the embodiment, the specific sequence of steps may be interchanged with others replaced. Further details of these elements are found throughout the present specification and more particularly below.

At the process 2010, the signals 1952, 1954, 1956 and 1958 are provided to the time delay beam forming system 600 as the signals 611, 613, 615 and 617 respectively. The phase shifters 610, 612, 614 and 616 are adjusted and the variable true time delay system 630, 632, 634 and 636 are adjusted to provide the signals 642, 644, 646 and 648 the same relative phase and the same relative time delay. At the process 2020, two signal channels are selected from the signal channels corresponding to the signals 642, 644, 646, and 648. Switches 660 and 670 both output a signal from one of the two selected signal channels, and switches 662 and 672 both output a signal from the other one of the two selected signal channels. At the process 2030, the phase difference (PD) is measured by the correlative receiver 680. The measured phase difference corresponds to two input signals to the correlative receiver 680, related to the signals 642, 644, 646 and 648 having the same phase and the same time delay. Processes 2020 and 2030 may be repeated at each desired frequency for all relevant combinations of pair of signals from the inputs of the combiner and divider system 640. The values of the correlation value may be compiled into a table similar to Table 6. In Table 6, #1, #2, #3 and #4 represent signal channels corresponding to the signals 642, 644, 646 and 648 respectively. Table 6 is merely an example, which should not unduly limit the scope of the claims. One of ordinary skill in the art would recognize many variations, alternatives, and modifications.

TABLE 6

| | 2.20 G | 2.24 GHz | 2.28 GHz | 2.32 GHz | 2.36 GHz |
|---|---|---|---|---|---|
| #1 and #1 | $PD_{1,1,2.20}$ | $PD_{1,1,2.24}$ | $PD_{1,1,2.28}$ | $PD_{1,1,2.32}$ | $PD_{1,1,2.36}$ |
| #2 and #2 | $PD_{2,2,2.20}$ | $PD_{2,2,2.24}$ | $PD_{2,2,2.28}$ | $PD_{2,2,2.32}$ | $PD_{2,2,2.36}$ |
| #3 and #3 | $PD_{3,3,2.20}$ | $PD_{3,3,2.24}$ | $PD_{3,3,2.28}$ | $PD_{3,3,2.32}$ | $PD_{3,3,2.36}$ |
| #4 and #4 | $PD_{4,4,2.20}$ | $PD_{4,4,2.24}$ | $PD_{4,4,2.28}$ | $PD_{4,4,2.32}$ | $PD_{4,4,2.36}$ |
| #1 and #2 | $PD_{1,2,2.20}$ | $PD_{1,2,2.24}$ | $PD_{1,2,2.28}$ | $PD_{1,2,2.32}$ | $PD_{1,2,2.36}$ |
| #1 and #3 | $PD_{1,3,2.20}$ | $PD_{1,3,2.24}$ | $PD_{1,3,2.28}$ | $PD_{1,3,2.32}$ | $PD_{1,3,2.36}$ |
| #1 and #4 | $PD_{1,4,2.20}$ | $PD_{1,4,2.24}$ | $PD_{1,4,2.28}$ | $PD_{1,4,2.32}$ | $PD_{1,4,2.36}$ |
| #2 and #3 | $PD_{2,3,2.20}$ | $PD_{2,3,2.24}$ | $PD_{2,3,2.28}$ | $PD_{2,3,2.32}$ | $PD_{2,3,2.36}$ |
| #2 and #4 | $PD_{2,4,2.20}$ | $PD_{2,4,2.24}$ | $PD_{2,4,2.28}$ | $PD_{2,4,2.32}$ | $PD_{2,4,2.36}$ |
| #3 and #4 | $PD_{3,4,2.20}$ | $PD_{3,4,2.24}$ | $PD_{3,4,2.28}$ | $PD_{3,4,2.32}$ | $PD_{3,4,2.36}$ |

Figure 21:
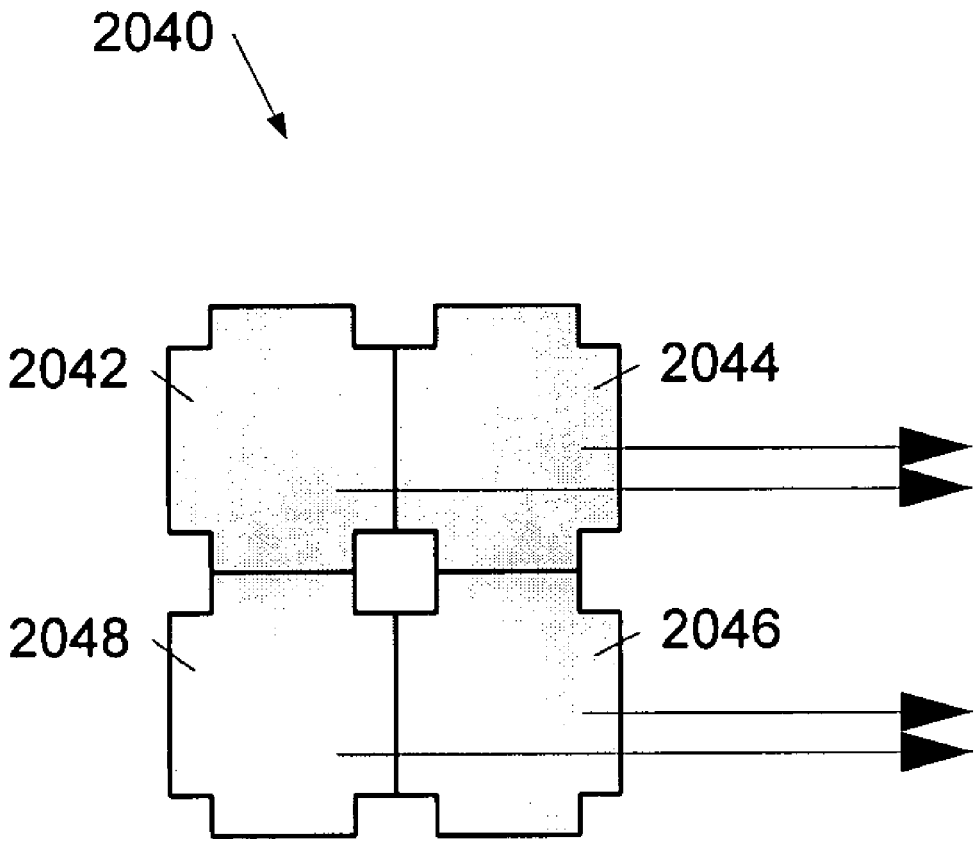
FIG. 21 is a simplified diagram for a phased array antenna system.

Certain embodiments of the present invention as shown in FIGS. 1–20 can be applied to a phased array antenna. FIG. 21 is a simplified diagram for a phased array antenna system. An antenna system 2040 includes four panels 2042, 2044, 2046 and 2048. In order to improve the frequency response of the antenna system 2040, the outputs of the panels 2042, 2044, 2046 and 2048 are inputted into the time delay beam forming system 600 as shown in FIG. 6. As discussed above and further emphasized here, the application of the present invention to FIG. 21 is merely an example, which should not unduly limit the scope of the present invention. One of ordinary skill in the art would recognize many variations, alternatives, and modifications.

The present invention has various advantages. For example, certain embodiments of the present invention reduce complexity of calibration process that usually involves physical manipulation of a large phased array antenna. Some embodiments of the present invention reduce the amount of time required for system integration in the factory. After system deployment, periodic maintenance procedures for periodic test, calibration and performance verifications can be simplified. Certain embodiments of the present invention can make real time measurements and estimate relative time delays and phase delays between received signals. Some embodiments of the present invention can lower costs of making and using phased array antenna systems.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A system for processing signals, the system comprising:

a first phase shifter configured to receive or generate a first signal;

a second phase shifter configured to receive or generate a second signal;

a first variable time delay system coupled to the first phase shifter and configured to generate or receive a third signal;

a second variable time delay system coupled to the second phase shifter and configured to generate or receive a fourth signal;

a first signal processing system coupled to the first variable time delay system and the second variable time delay system and configured to generate or receive a fifth signal;

a sampling system configured to sample at least the third signal and the fourth signal and generate at least a sixth signal and a seventh signal respectively;

a switching system configured to receive the at least a sixth signal and a seventh signal and output an eighth signal and a ninth signal, the eighth signal being the same as one of the at least a sixth signal and a seventh signal, the ninth signal being the same as one of the at least a sixth signal and a seventh signal;

a measuring system configured to receive the eighth signal and the ninth signal and process at least information associated with the eighth signal and the ninth signal.

2. The system of claim 1 wherein the first variable time delay system comprises:

a second signal processing system coupled to the first phase shifter and configured to generate or receive at least a first divided signal and a second divided signal;

a third time delay system configured to receive or generate the first divided signal, generate or receive a third divided signal, and provide a first time delay to the first divided signal or the third divided signal;

a fourth time delay system configured to received or generate the second divided signal, generate or received a fourth signal, and provide a second time delay to the second divided signal or the fourth divided signal;

a first attenuator configured to receive or generate the third divided signal and generate or receive a fifth divided signal;

a second attenuator configured to receive or generate the fourth divided signal and generate or receive a sixth divided signal;

a third signal processing system configured to receive or generate the fifth divided signal and the sixth divided signal and generate or receive the third signal.

3. The system of claim 1 wherein the switching system comprises:

a first switch configured to receive the at least a sixth signal and a seventh signal and select one of the at least a sixth signal and a seventh signal as a first selected signal;

a second switch configured to receive the at least a sixth signal and a seventh signal and select one of the at least a sixth signal and a seventh signal as a second selected signal;

a third switch configured to receive the first selected signal and the fifth signal and select one of the first selected signal and the fifth signal as the eighth signal;

a fourth switch configured to receive the second selected signal and a test signal and select one of the second selected signal and the test signal as the ninth signal.

4. The system of claim 1 wherein the eighth signal is the same as the ninth signal.

5. The system of claim 1 wherein the eighth signal is different from the ninth signal.

6. The system of claim 1 wherein the at least the third signal and the fourth signal comprises the fifth signal, and the at least a sixth signal and a seventh signal comprises a tenth signal.

7. The system of claim 6 wherein the sixth signal is sampled from the third signal, the seventh signal is sampled from the fourth signal, and the tenth signal is sampled form the fifth signal.

8. The system of claim 1 wherein the measuring system is configured to determine a phase difference between the eighth signal and the ninth signal.

9. The system of claim 8 wherein the measuring system is further configured to determined a ratio between a magnitude of the eighth signal and the ninth signal.

10. The system of claim 1 wherein the first signal processing system is a signal combiner, a signal divider, or a signal combiner and divider.

11. The system of claim 10 wherein the first signal processing system is a signal combiner.

12. The system of claim 1, and further comprising:

a first amplifier coupled between the first phase shifter and the first variable time delay system;

a second amplifier coupled between the second phase shifter and the second variable time delay system.

13. A method for using a system, the method comprising:

providing a system wherein the system comprises:

a first phase shifter configured to provide a first phase shift;

a second phase shifter configured to provide a second phase shift;

a first variable time delay system coupled to the first phase shifter and configured to provide a first time delay;

a second variable time delay system coupled to the second phase shifter and configured to provide a second time delay;

a signal processing system coupled to the first variable time delay system and the second variable time delay system;

a sampling system configured to sample at least a first output of the first variable time delay system and a second output of the second variable time delay system;

a switching system configured to receive the at least a first output and a second output and output a third signal and a fourth signal, the third signal being the same as one of the at least a first output and a second output, the fourth signal same as one of the at least a first output and a second output; and a measuring system configured to process at least information associated with the third signal and the fourth signal;

inputting a fifth signal to the first phase shifter;

inputting a sixth signal to the second phase shifter, the sixth signal and the fifth signal associated with substantially the same phase and the same time delay;

adjusting the first output and the second output, the adjusted first output and the adjusted second output associated with substantially the same phase and the same time delay;

processing information associated with the third signal and the fourth signal, the third signal related to the fifth signal, the fourth signal related to the sixth signal; and determining a phase difference based on at least information associated with the third signal and the fourth signal.

14. A system for processing signals, the system comprising:

a first phase shifter configured to provide a first phase shift;

a second phase shifter configured to provide a second phase shift;

a first variable time delay system coupled to the first phase shifter and configured to provide a first time delay;

a second variable time delay system coupled to the second phase shifter and configured to provide a second time delay;

a signal processing system coupled to the first variable time delay system and the second variable time delay system;

a sampling system configured to sample at least a first output of the first variable time delay system and a second output of the second variable time delay system;

a switching system configured to receive the at least a first output and a second output and output a third signal and a fourth signal, the third signal being the same as one of the at least a first output and a second output, the fourth signal same as one of the at least a first output and a second output; and a measuring system configured to process at least information associated with the third signal and the fourth signal.

* * * * *

UNITED STATES PATENT AND TRADEMARK OFFICE

CERTIFICATE OF CORRECTION

PATENT NO. : 7,009,560 B1
APPLICATION NO. : 10/714498
DATED : March 7, 2006
INVENTOR(S) : Lawrence K. Lam et al.

It is certified that error appears in the above-identified patent and that said Letters Patent is hereby corrected as shown below:

IN THE SPECIFICATION

Column 7, line 41, "angel" should read --angle--.

Column 15, line 29, "$\{+j\phi_o+j\pi\tau_2 f+j\phi_2\}=$" should read -- $\{+j\phi_o+j2\pi\tau_2 f+j\phi_2\}=$ --.

Column 15, line 33, Add "or", before "$a_2$*exp";
*and*; "$\{+j\phi_o+j\pi\tau_3 f+j\phi_3\}=$" should read --$\{+j\phi_o+j2\pi\tau_3 f+j\phi_3\}=$ --.

Column 16, line 13, "$(\tau_2-\tau_2)$" should read --$(\tau_2-\tau_1)$--.

Column 16, line 16, "show" should read --shown--.

Column 18, line 25, "$\Delta\Sigma$=1.4682 nsec, should read -- $\Delta\tau$=1.4682 nsec,--.

Column 18, line 29, "a3 exp $\{j2\pi(\tau_3-\tau_2)\Delta_2\}$]" should read --a3 exp $\{j2\pi(\tau_3-\tau_2)\Delta f_2\}$]--.

Column 18, line 30, "$\Delta f_{2=25.5}$" should read -- $\Delta f_2$=25.5--.

Column 18, line 31, "$\phi_o$=22.50, $a_{2=0.5}$, and $a_{3=0.76}$"
should read -- $\phi_o$=22.5°, $a_2$=0.5, and $a_3$=0.76--.

Column 18, lines 40-41, "$\tau_{2=2.25}$nsec, $f_{1=2200.5}$ MHz, and $f_{2=2275.5}$ MHz"
should read --$\tau_2$=2.25 nsec, $f_1$=2200.5 MHz, and $f_2$=2275.5 MHz--.

UNITED STATES PATENT AND TRADEMARK OFFICE

CERTIFICATE OF CORRECTION

PATENT NO. : 7,009,560 B1
APPLICATION NO. : 10/714498
DATED : March 7, 2006
INVENTOR(S) : Lawrence K. Lam et al.

It is certified that error appears in the above-identified patent and that said Letters Patent is hereby corrected as shown below:

IN THE CLAIMS

Claim 7, column 23, line 36, "form" should read --from--.

Signed and Sealed this

Twenty-sixth Day of December, 2006

JON W. DUDAS
*Director of the United States Patent and Trademark Office*